US012428838B2

(12) United States Patent
Peltonen et al.

(10) Patent No.: US 12,428,838 B2
(45) Date of Patent: Sep. 30, 2025

(54) METHOD AND ARRANGEMENT FOR SUPPORTING A FLOOR ELEMENT ON A BEAM AND BEAM

(71) Applicant: PEIKKO GROUP OY, Lahti (FI)

(72) Inventors: Simo Peltonen, Lahti (FI); Jaakko Yrjölä, Lahti (FI); Matti Vartiainen, Lahti (FI)

(73) Assignee: PEIKKO GROUP OY, Lahti (FI)

( * ) Notice: Subject to any disclaimer, the term of this patent is extended or adjusted under 35 U.S.C. 154(b) by 820 days.

(21) Appl. No.: 17/774,377

(22) PCT Filed: Nov. 4, 2020

(86) PCT No.: PCT/FI2020/050728
§ 371 (c)(1),
(2) Date: May 4, 2022

(87) PCT Pub. No.: WO2021/089919
PCT Pub. Date: May 14, 2021

(65) Prior Publication Data

US 2022/0364361 A1 Nov. 17, 2022

(30) Foreign Application Priority Data

Nov. 8, 2019 (FI) ..... 20195957

(51) Int. Cl.
*E04B 5/04* (2006.01)
*E04B 1/20* (2006.01)
(Continued)

(52) U.S. Cl.
CPC ..... *E04B 5/04* (2013.01); *E04B 1/20* (2013.01); *E04B 1/4157* (2013.01); *E04B 1/30* (2013.01)

(58) Field of Classification Search
CPC ... E04B 5/04; E04B 5/043; E04B 5/06; E04B 5/16; E04B 5/18; E04B 5/23; E04B 5/265;
(Continued)

(56) References Cited

U.S. PATENT DOCUMENTS 4,398,378 A * 8/1983 Heitzman ..... E04B 1/04 52/251
4,627,212 A * 12/1986 Yee ..... E04C 5/165 285/294.1
(Continued)

FOREIGN PATENT DOCUMENTS

EP 1 978 172 A2 10/2008
JP 2013-019194 A 1/2013
(Continued)

OTHER PUBLICATIONS

Feb. 22, 2021 Search Report issued in International Patent Application No. PCT/FI2020/050728.
(Continued)

*Primary Examiner* — Jessica L Laux
(74) *Attorney, Agent, or Firm* — Oliff PLC

(57) ABSTRACT

A method and an arrangement for supporting a first floor element at a beam and a beam. The beam is provided with a supporting flange section configured to support the first floor element. The method includes supporting the first floor element on the supporting flange section so that a first space is formed between the first floor element and the beam, providing elongated transverse fittings in the beam, providing transverse reinforcements to extend between the beam and the first floor element. The elongated transverse fitting have a first free end at the first lateral side of the beam, and a first protective element is connected to the first free end of the elongated transverse fitting outside the web section of the beam.

24 Claims, 17 Drawing Sheets

Figure 1:
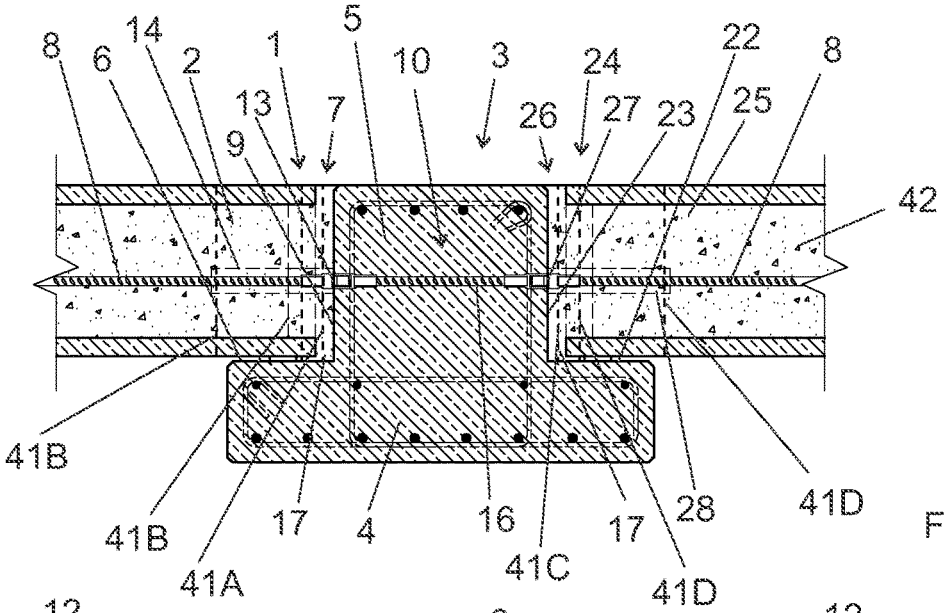

(51) Int. Cl.
*E04B 1/41* (2006.01)
*E04B 1/30* (2006.01)

(58) Field of Classification Search
CPC ..... E04B 5/26; E04B 5/38; E04B 5/43; E04B 5/44; E04B 1/41; E04B 1/4114; E04B 1/4157; E04B 1/4164; E04C 53/293; E04C 5/16; E04C 5/162; E04C 5/163; E04C 5/165
See application file for complete search history.

(56) References Cited

U.S. PATENT DOCUMENTS 5,305,573 A * 4/1994 Baumann ..... E04C 5/165 52/848
6,265,065 B1 * 7/2001 McCallion ..... B29C 63/42 174/394
6,581,343 B1 * 6/2003 Metelli ..... E04B 7/022 52/583.1
2012/0210656 A1 * 8/2012 Martin Hernandez ... E04B 5/48 52/125.1
2015/0300988 A1 * 10/2015 Park ..... G01N 3/02 324/209

FOREIGN PATENT DOCUMENTS

KR 10-2010-0091449 A 8/2010
WO 90/01596 A1 2/1990

OTHER PUBLICATIONS

Feb. 22, 2021 Written Opinion issued in International Patent Application No. PCT/FI2020/050728.

* cited by examiner

METHOD AND ARRANGEMENT FOR SUPPORTING A FLOOR ELEMENT ON A BEAM AND BEAM

FIELD OF THE INVENTION

The invention relates to a method for supporting a first end of a first floor element at a beam as defined in the preamble of independent claim 1.

The invention also relates to an arrangement method for supporting a first end of a first floor element at a beam as defined in the preamble of independent claim 9.

The invention also relates to beam for supporting a first end of a first floor element as defined in the preamble of independent claim 17.

OBJECTIVE OF THE INVENTION

The object of the invention is to provide a method and an arrangement for supporting a first end of a floor element on beam in such manner that it allows to demount the floor element from the beam and to re-use at least the beam and to provide a beam that can be re-used.

SHORT DESCRIPTION OF THE INVENTION

The method of the invention is characterized by the definitions of independent claim 1.

Preferred embodiments of the method are defined in the dependent claims 2 to 8.

The arrangement of the invention is correspondingly characterized by the definitions of independent claim 9.

Preferred embodiments of the arrangement are defined in the dependent claims 10 to 16.

The beam of the invention is correspondingly characterized by the definitions of independent claim 17.

Preferred embodiments of the arrangement are defined in the dependent claims 18 to 24.

The invention is based on providing elongated transverse fittings in the web section of the beam so that the elongated transverse fittings has a first free end that projects at least partly out of the beam at the first lateral side of the beam and by connecting a first protective member to the first free end of the elongated transverse fitting outside the web section of the beam. The advantage of this is that the first protective members allows to find the elongated transverse fittings in the fill material filled in the first space between the first end of the first floor element and the beam in a situation when the first floor element is separated from the beam in connection with at least partly disassembling the building in such way that neither the beam nor the elongated transverse fittings will be damaged during said separation. Such separation can include cutting in the fill material filled in the first space between the first end of the first floor element and the web section of the beam in the direction of the beam. As a consequence of this the beam can be separated from the building with undamaged or intact elongated transverse fittings and the beam can be reused as a part of another building or in another place in the same building.

LIST OF FIGURES

Figure 2:
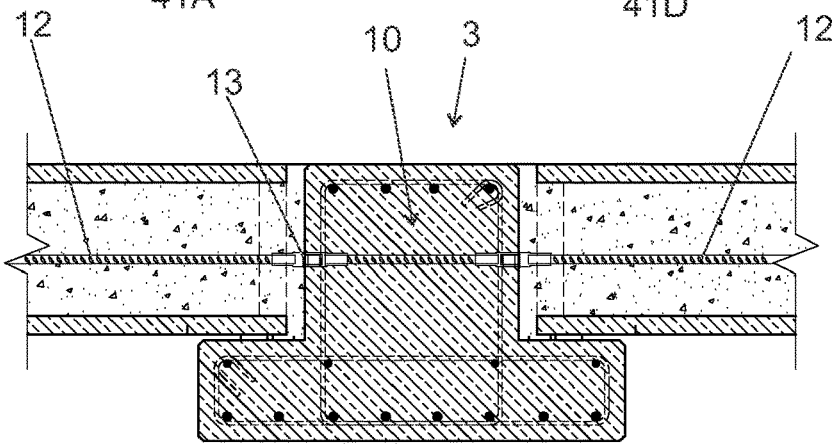
Figure 3:
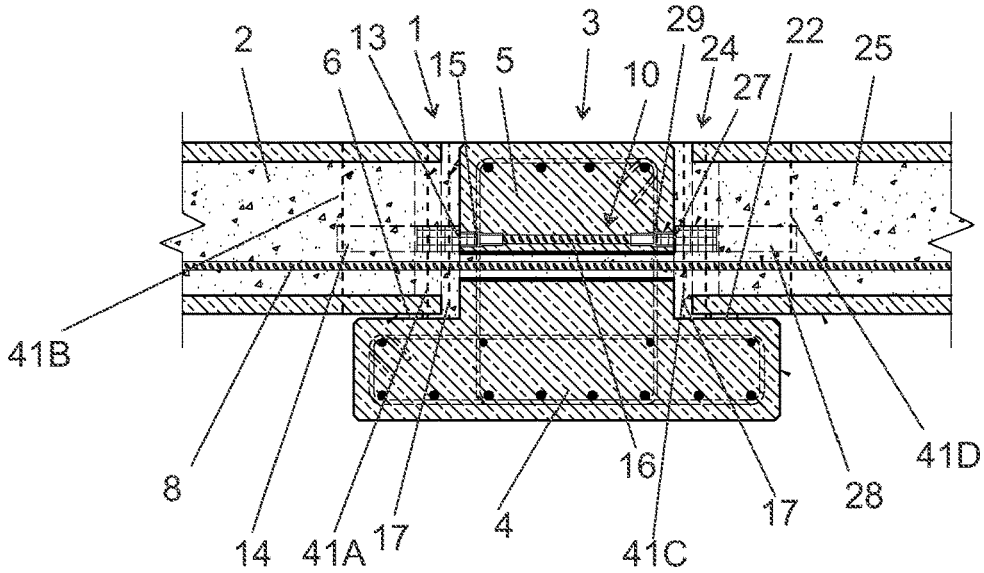
Figure 4:
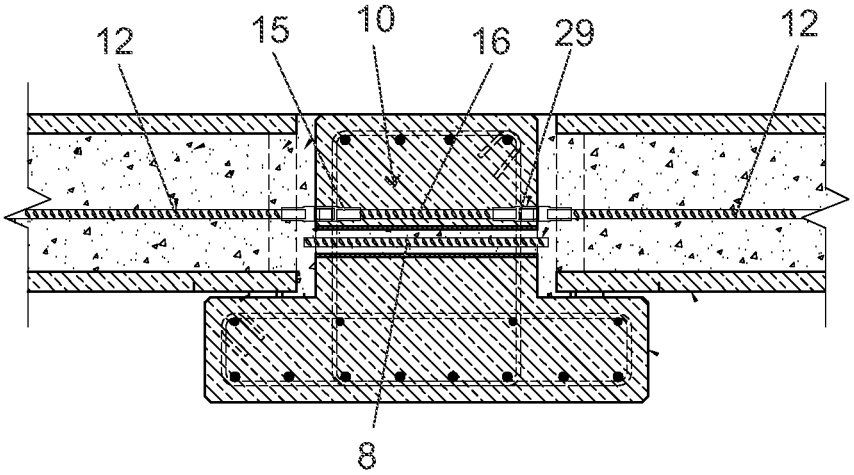
Figure 5:
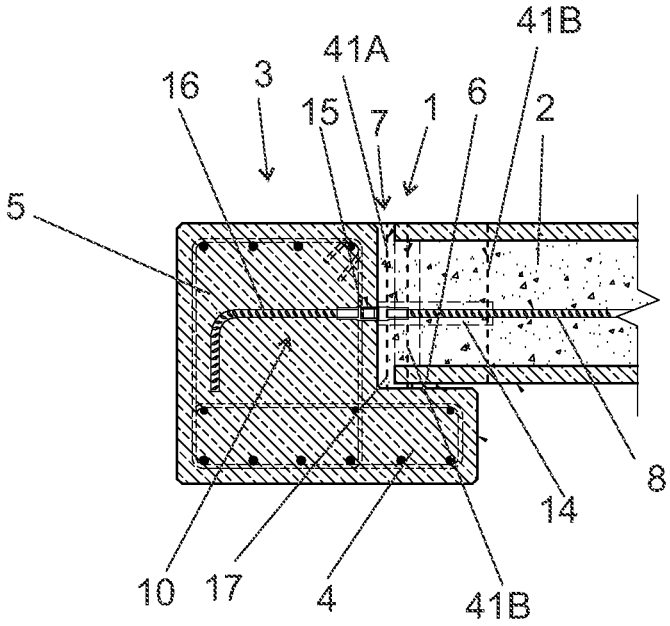
Figure 6:
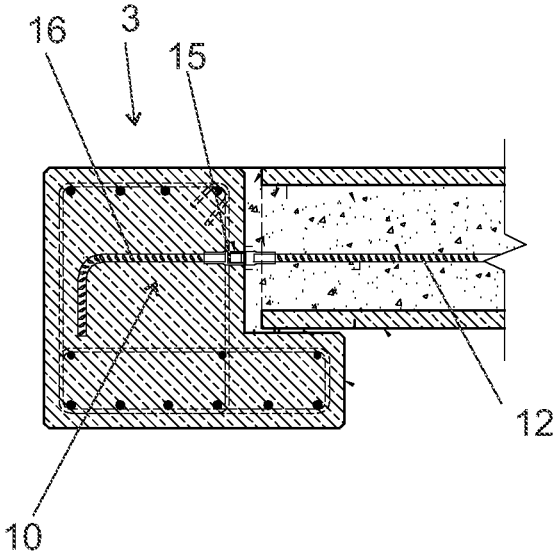
Figure 7:
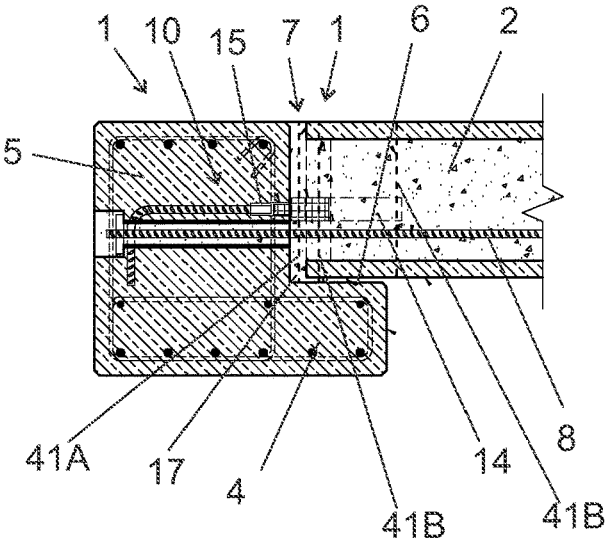
Figure 8:
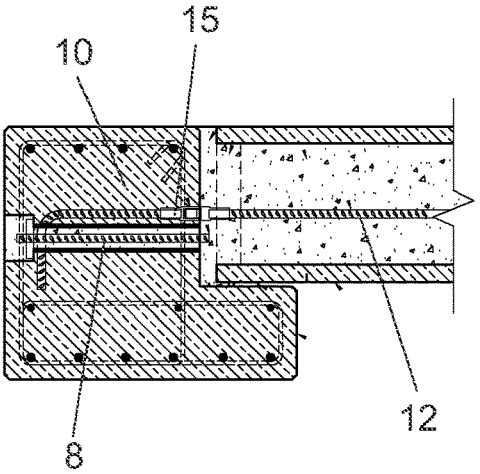
Figure 9:
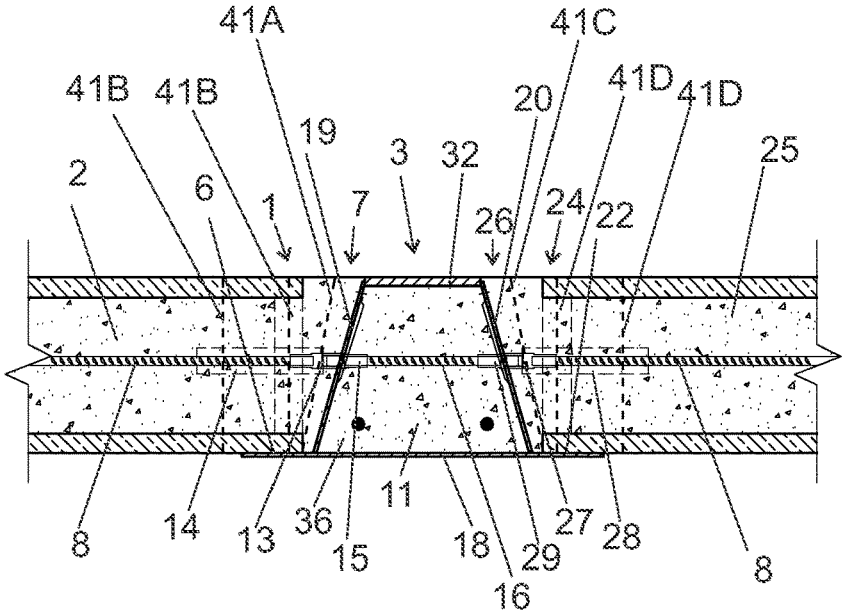
Figure 10:
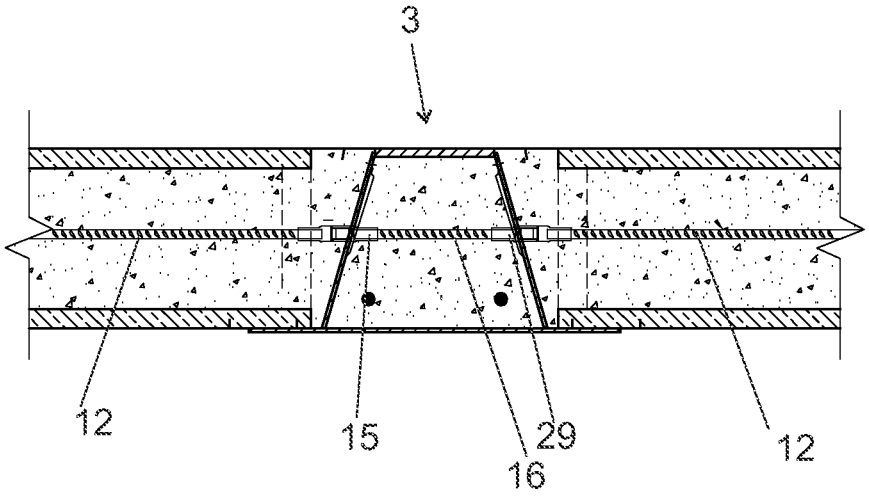
Figure 11:
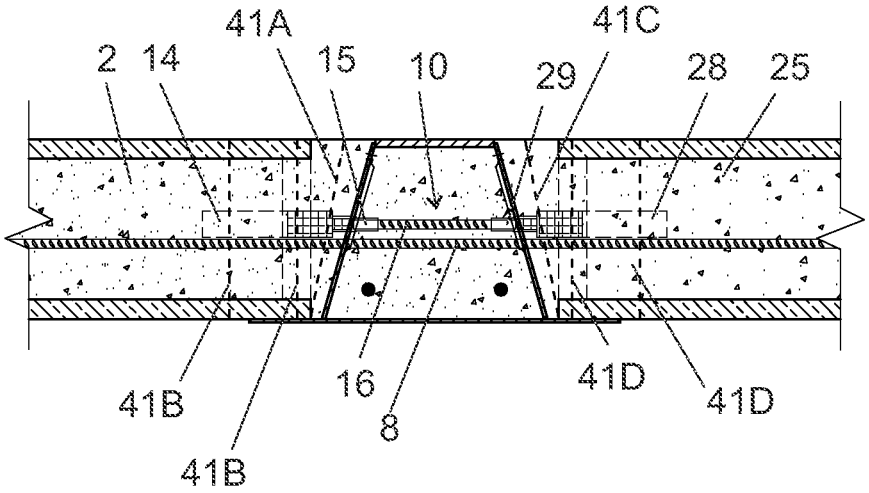
Figure 12:
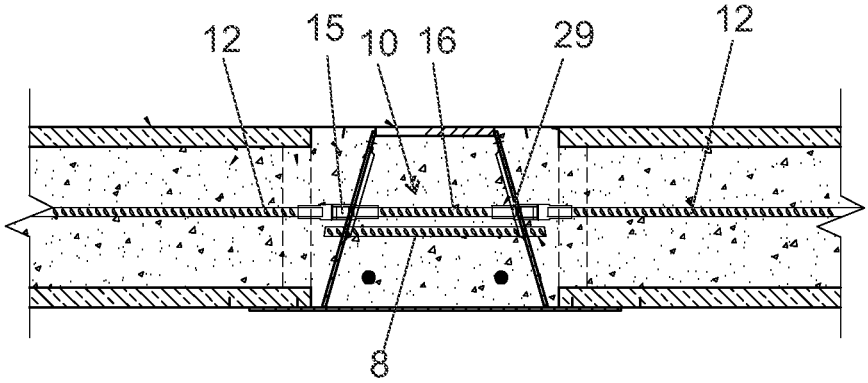
Figure 13:
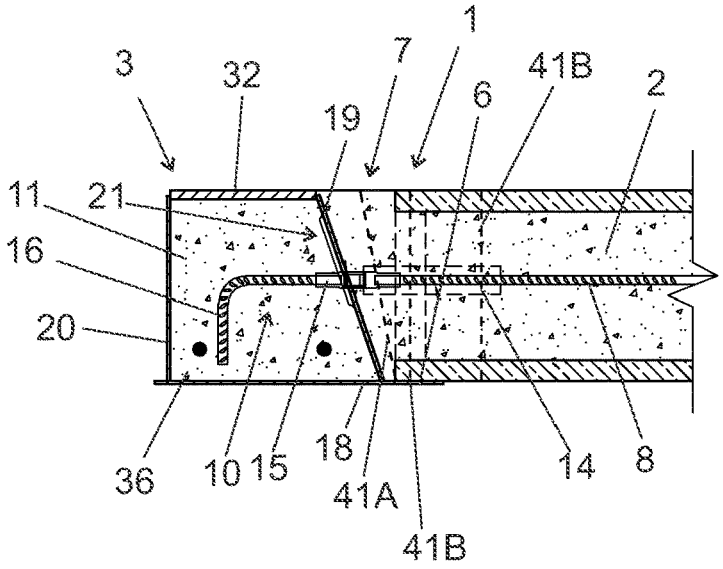
Figure 14:
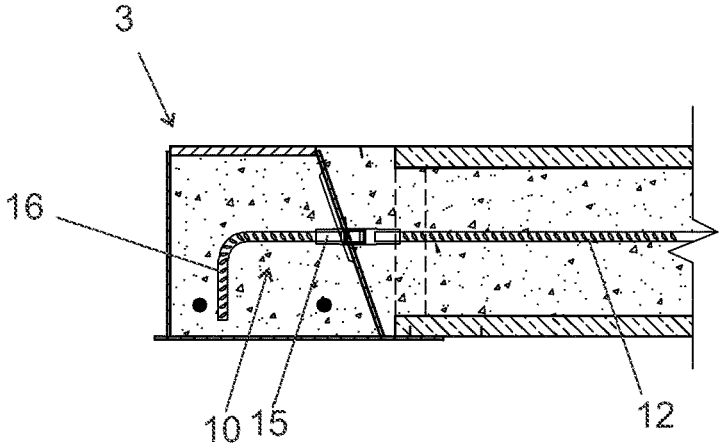
Figure 15:
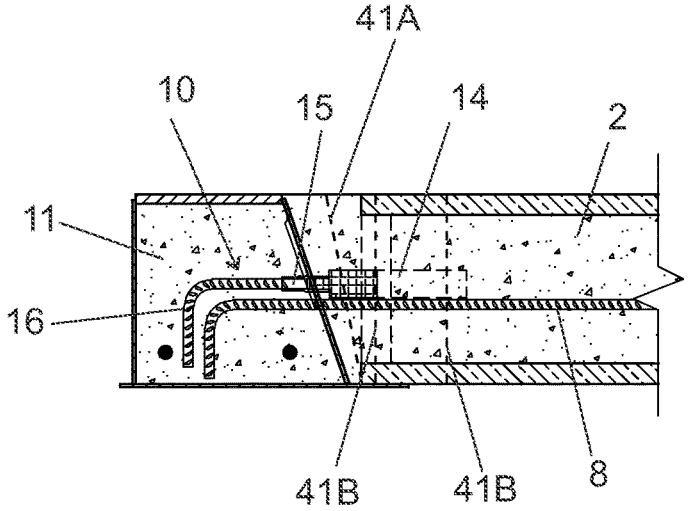
Figure 16:
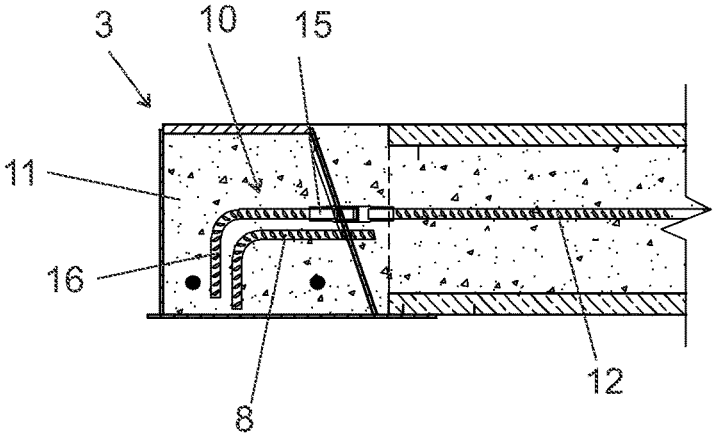
Figure 17:
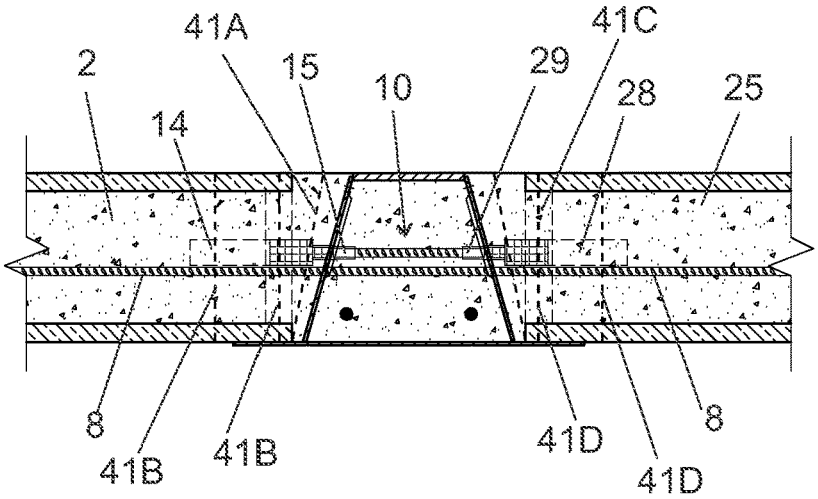
Figure 18:
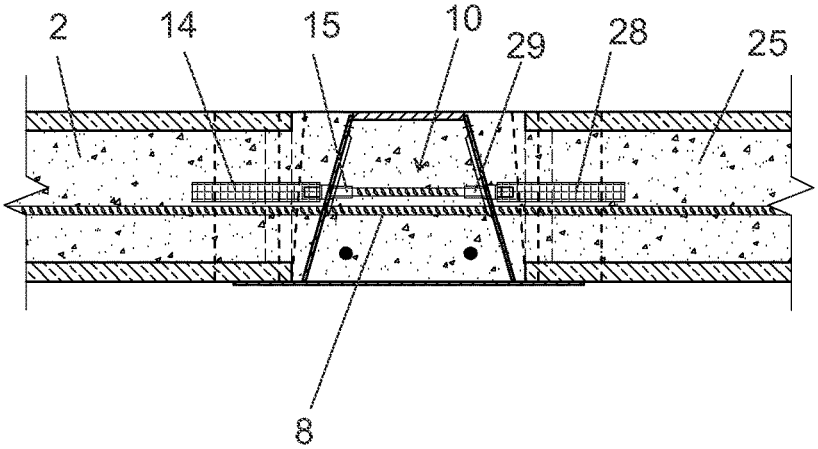
Figure 19:
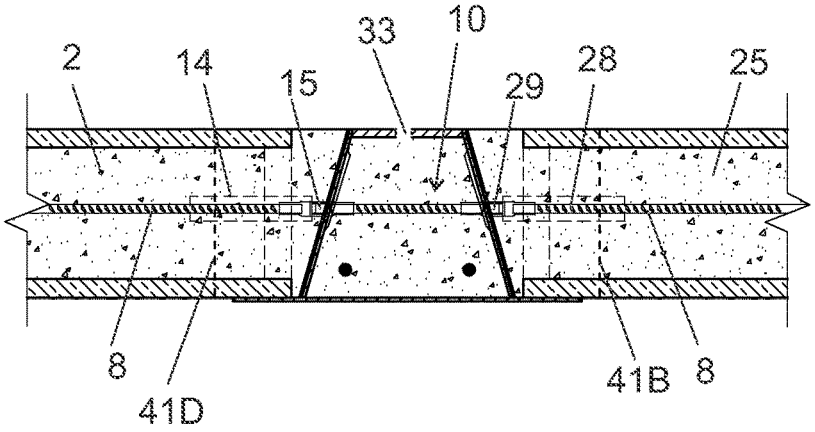
Figure 20:
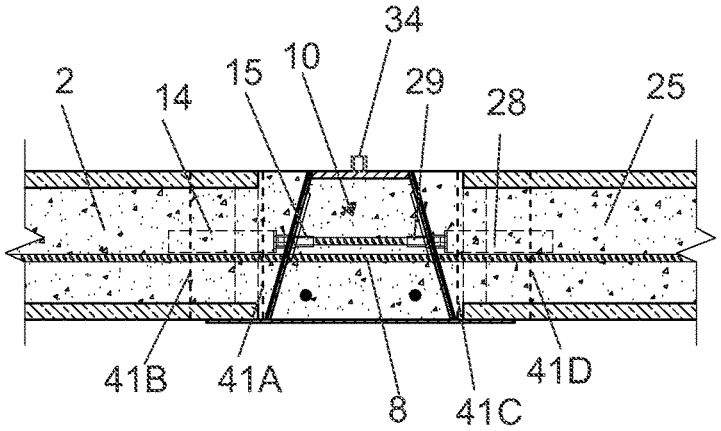
Figure 21:
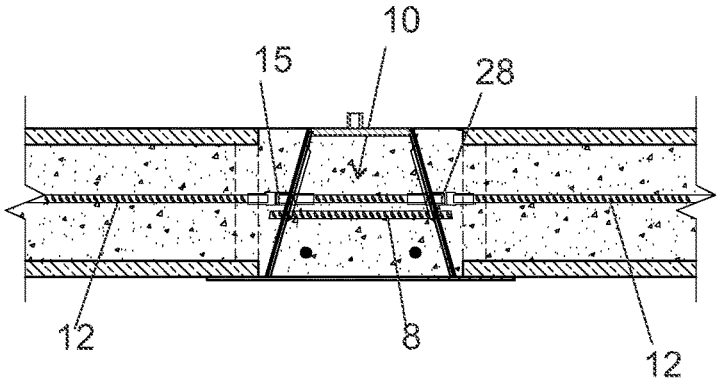
Figure 22:
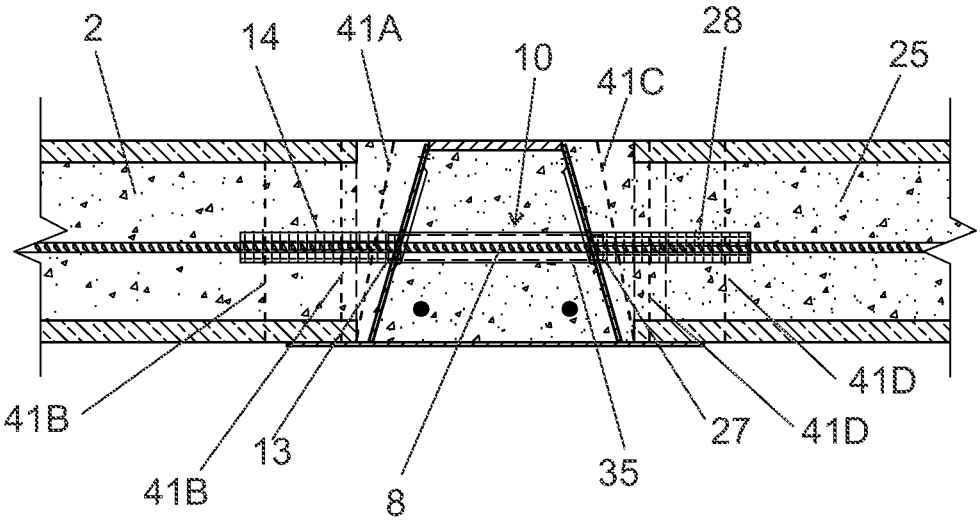
Figure 23:
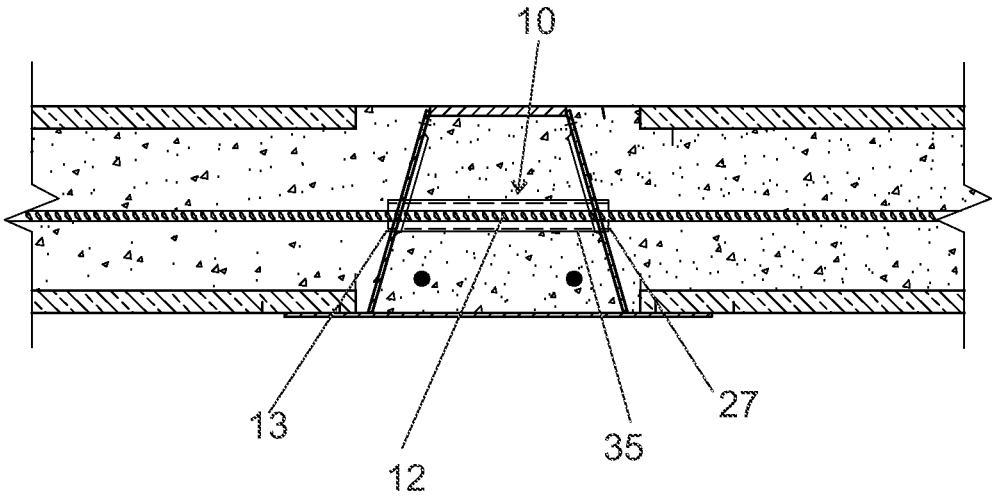
Figure 24:
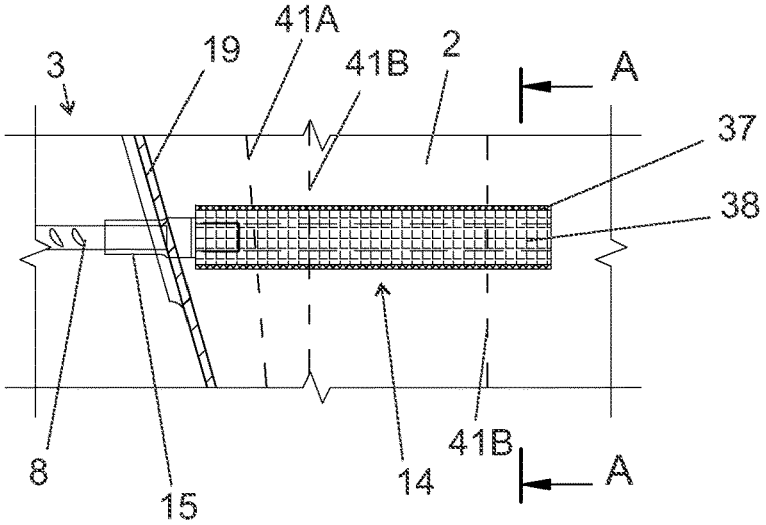
Figure 25:
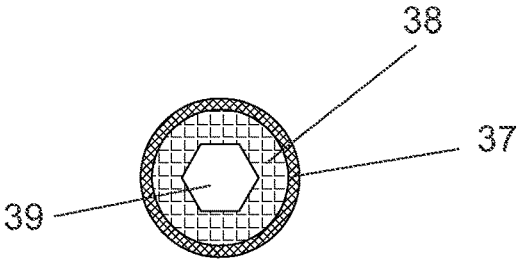
Figure 26:
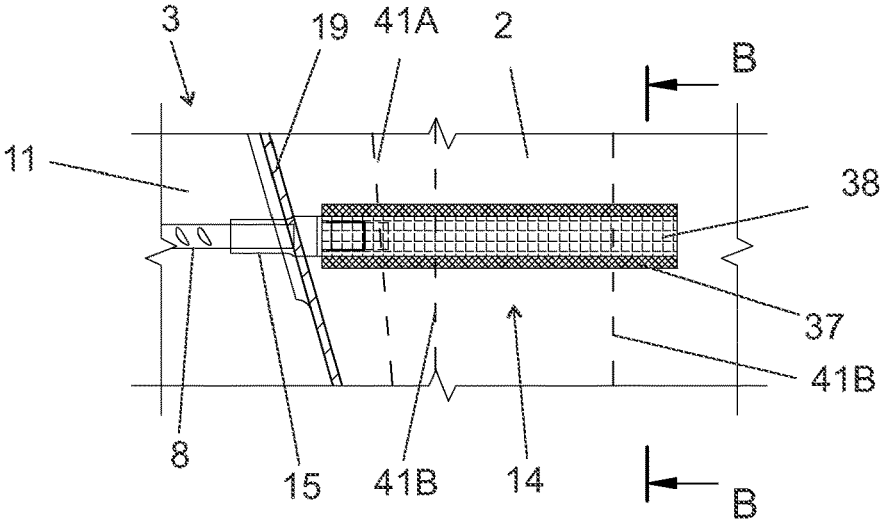
Figure 27:
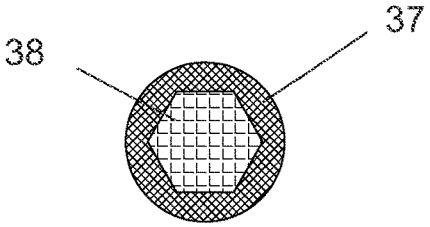
Figure 28:
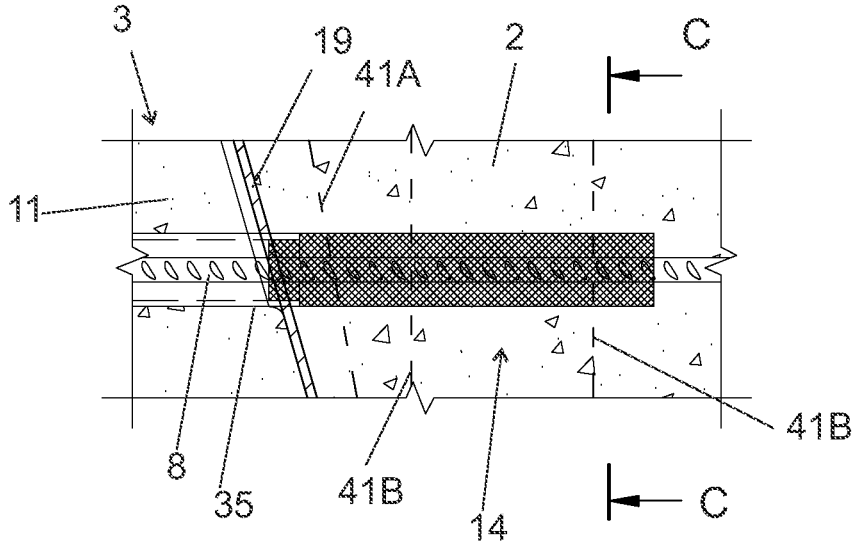
Figure 29:
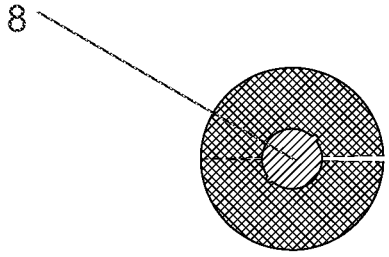
Figure 30:
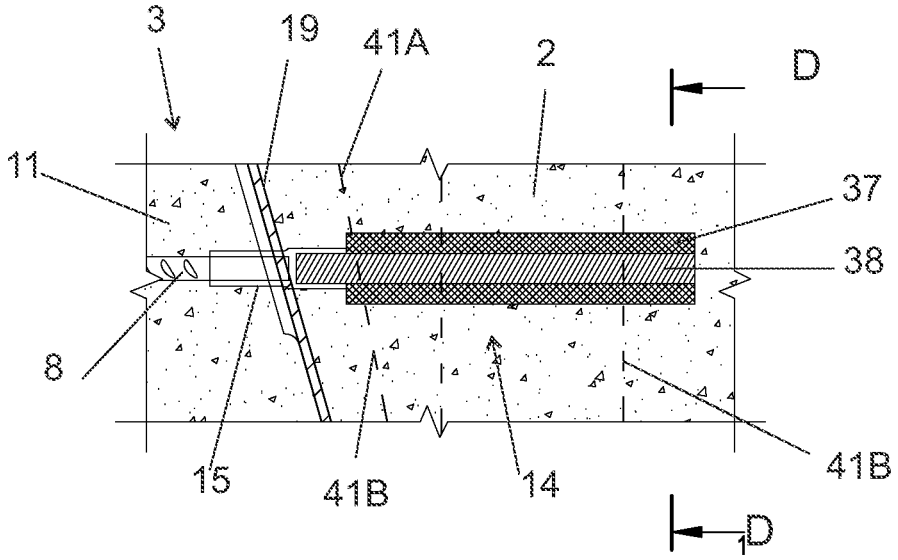
Figure 31:
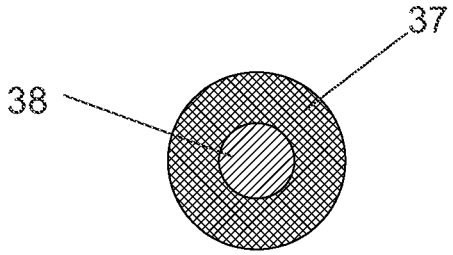
Figure 32:
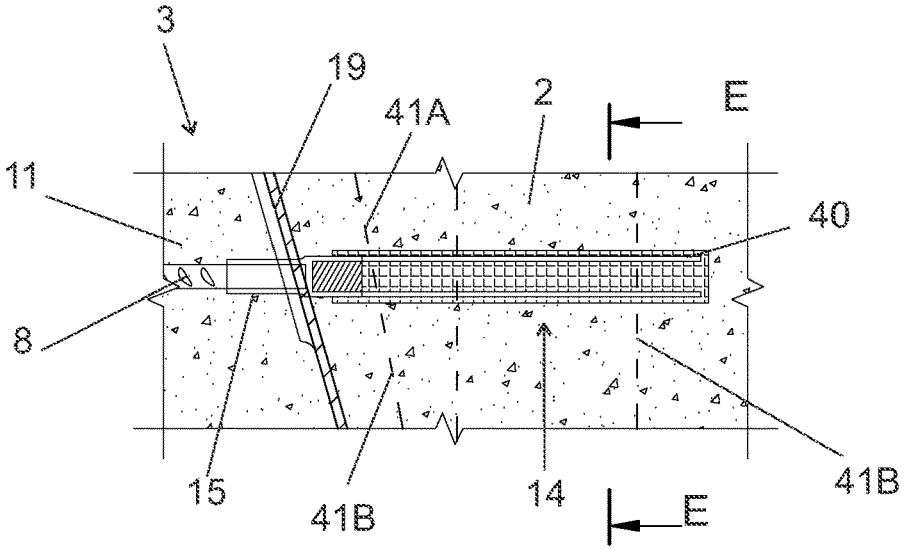
Figure 33:
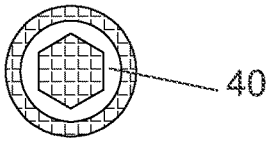
Figure 34:
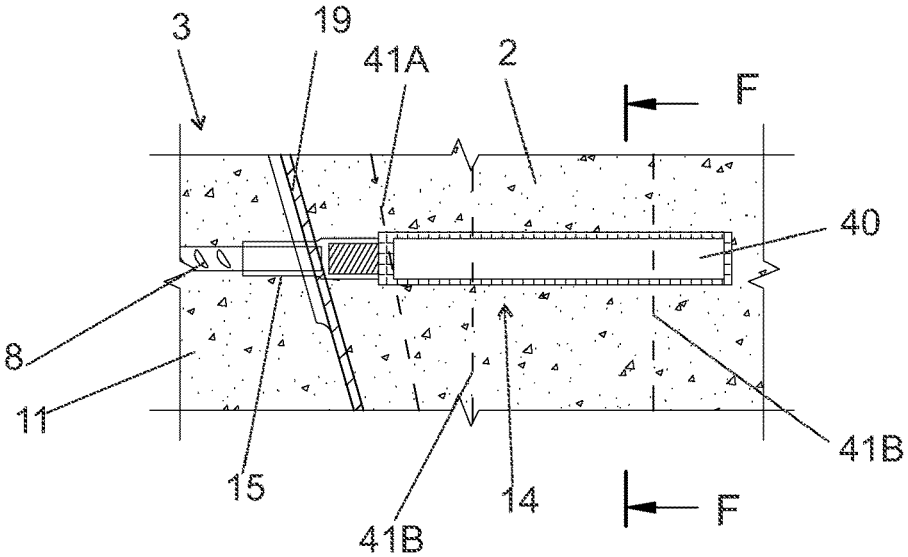
Figure 35:
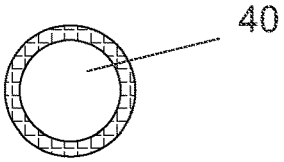
Figure 36:
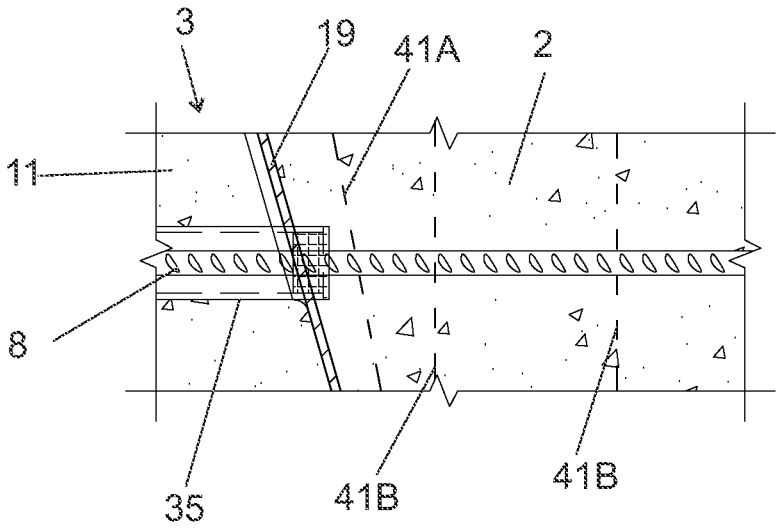
Figure 37:
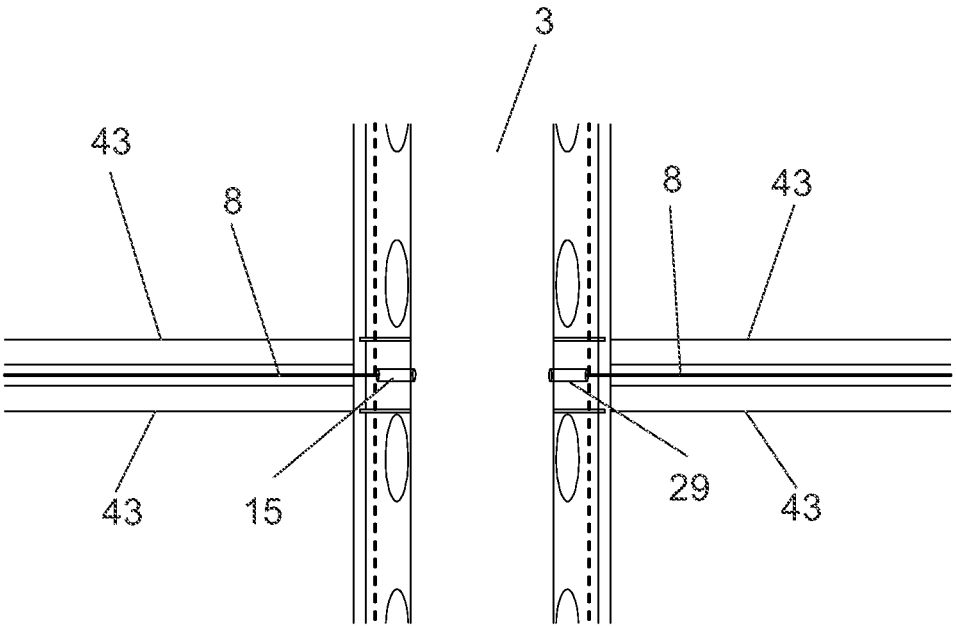
Figure 38:
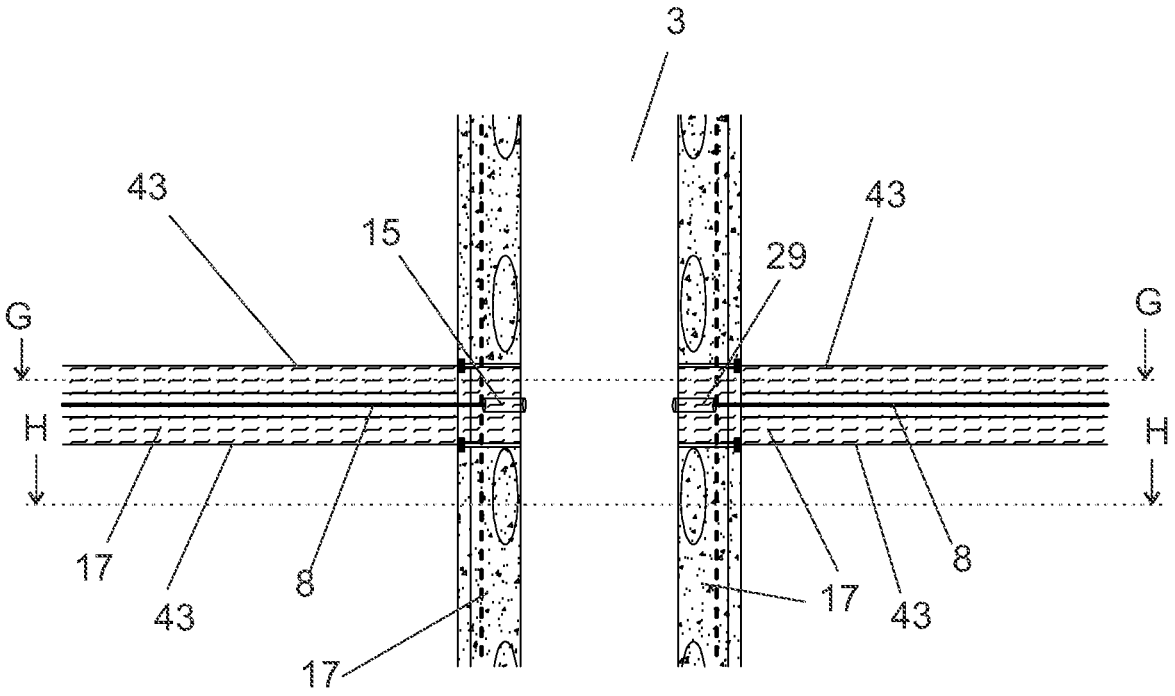
Figure 39:
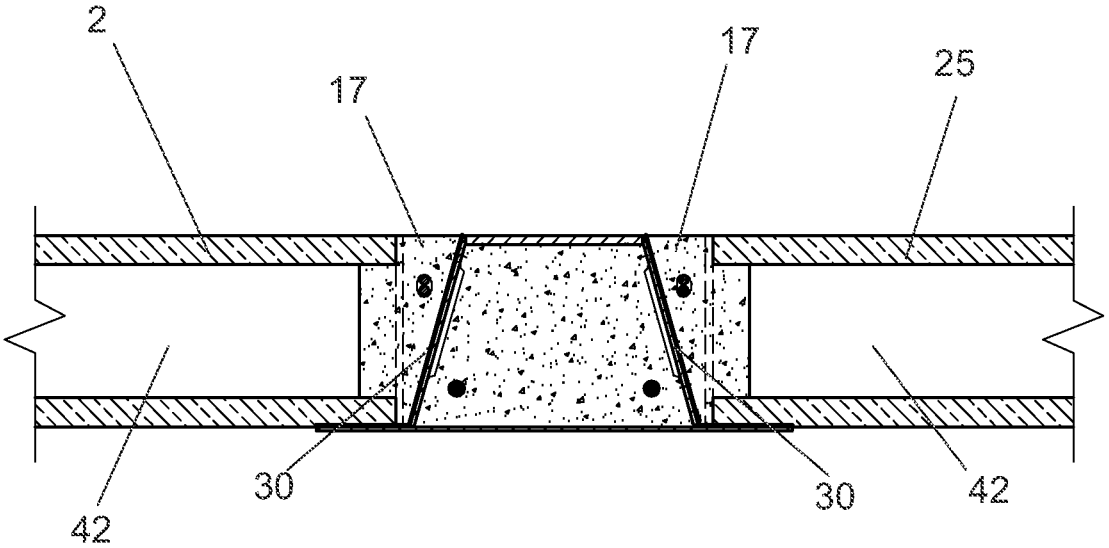
Figure 40:
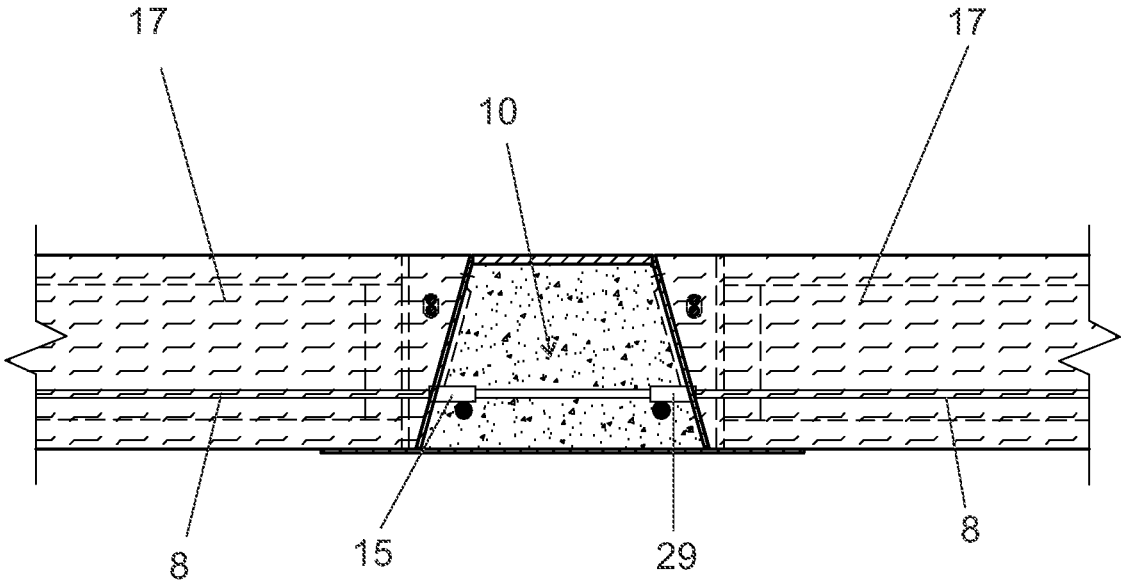
Figure 41:
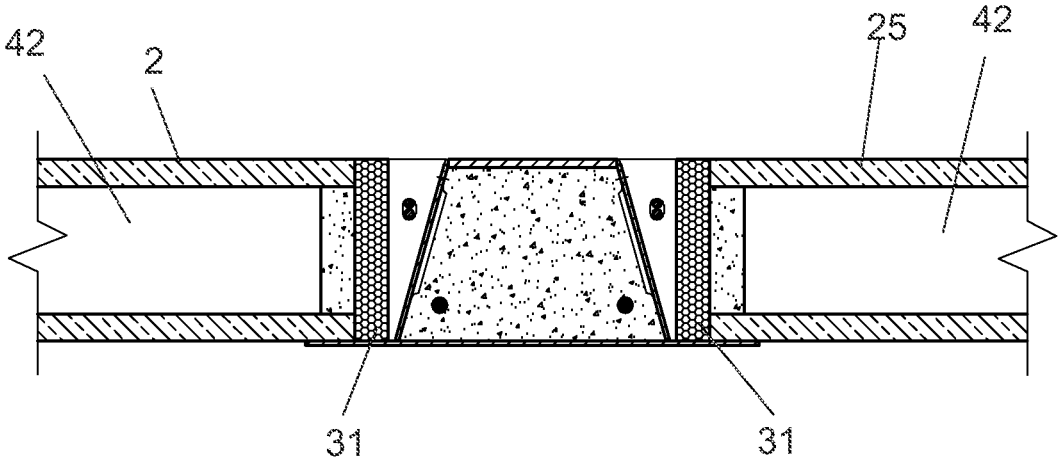
Figure 42:
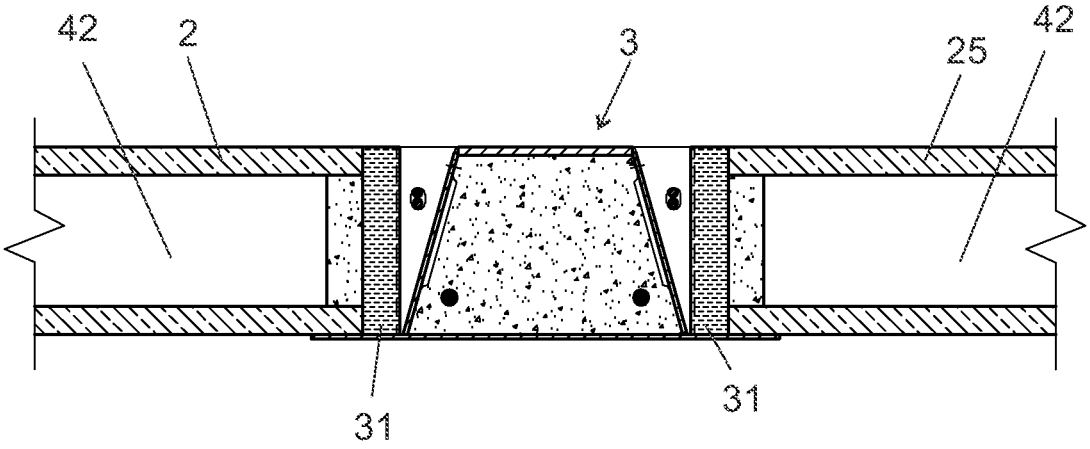
Figure 43:
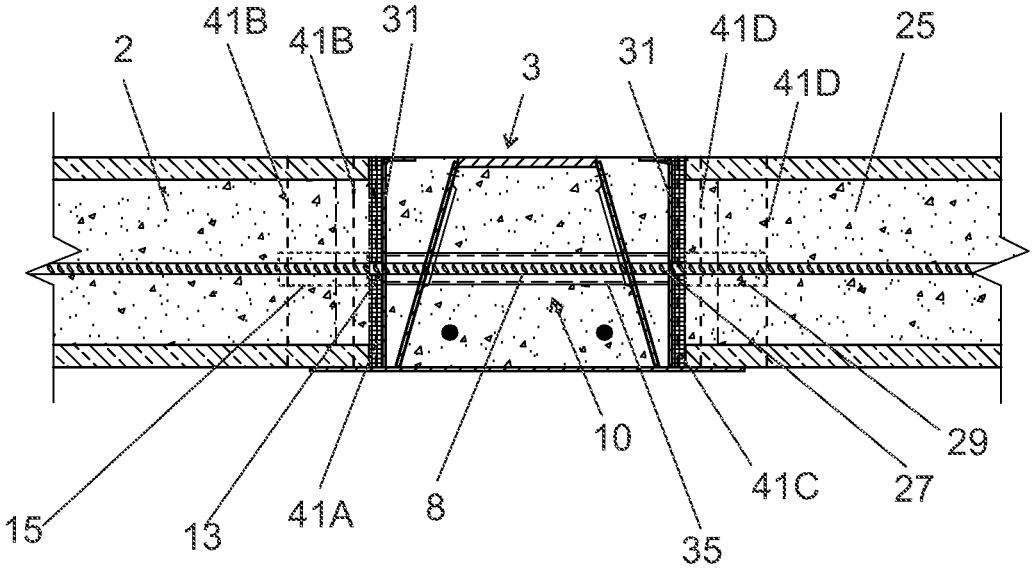
Figure 44:
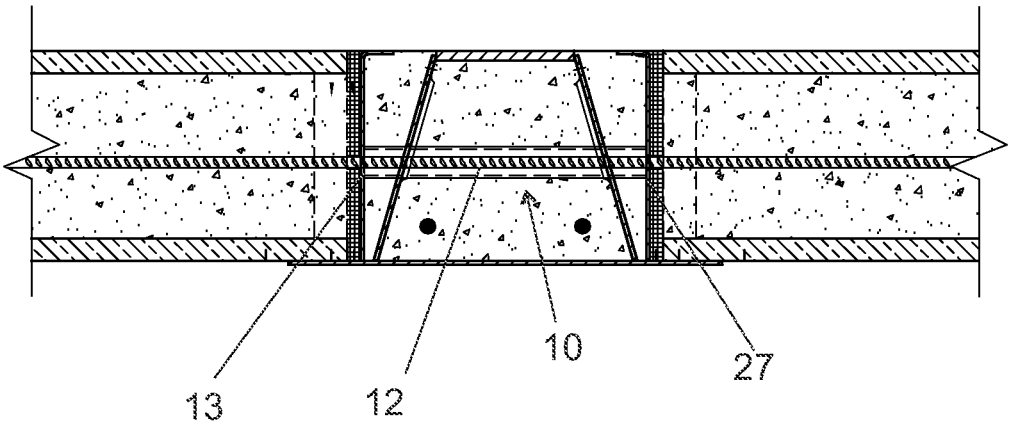
Figure 45:
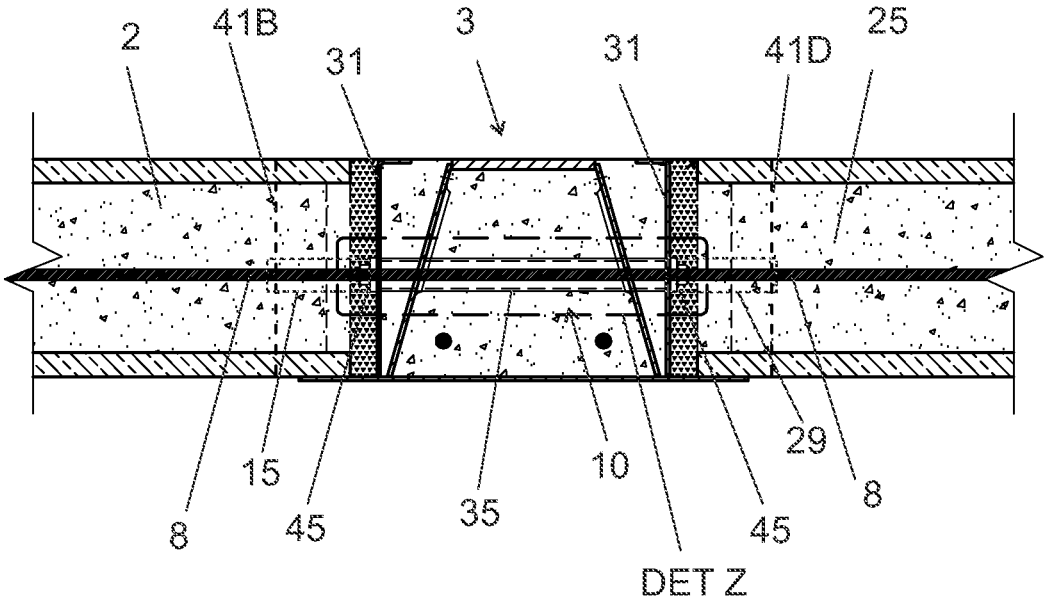
Figure 46:
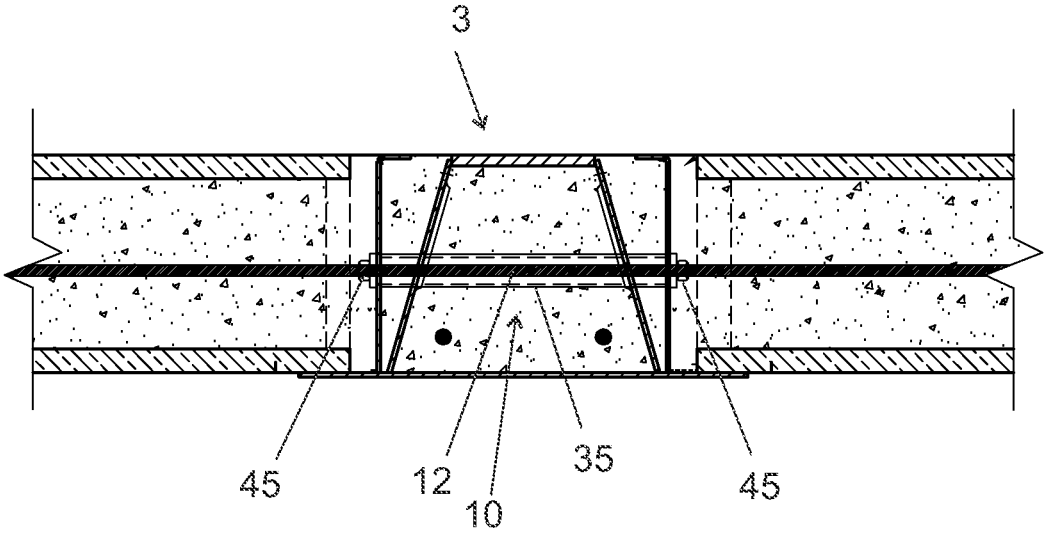
Figure 47:
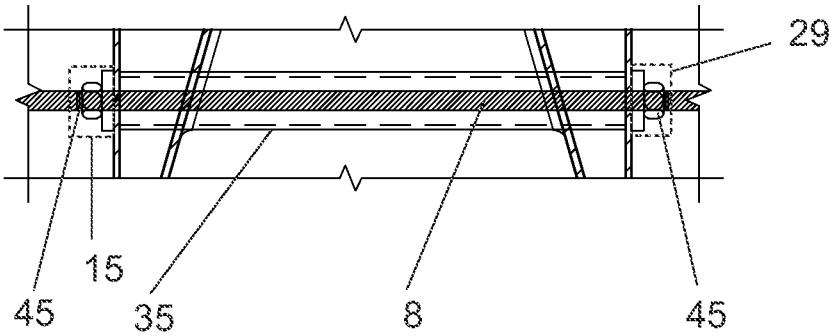
Figure 48:
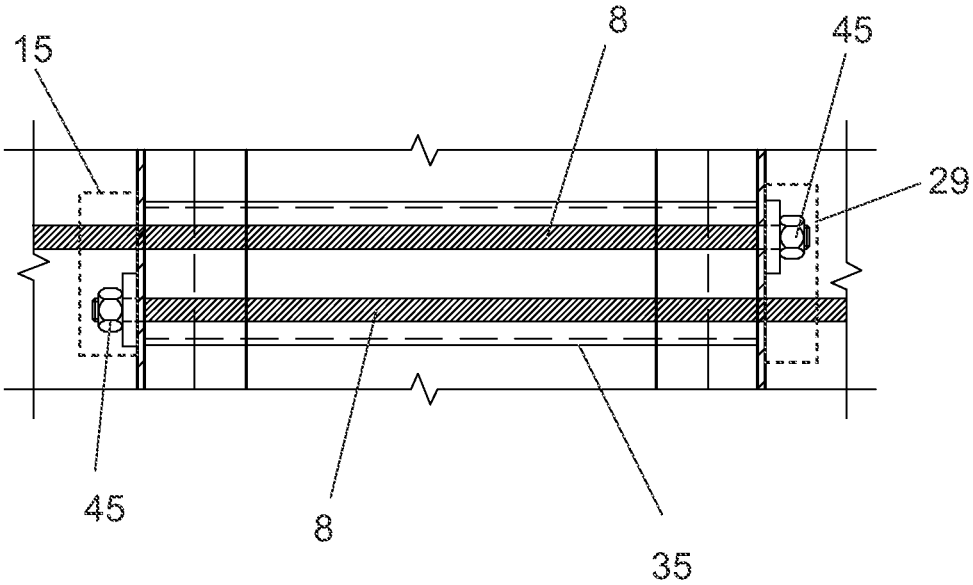

In the following the invention will described in more detail by referring to the figures, of which FIG. 1 shows a first embodiment where a first end of a first floor element and a second end of a second floor element is supported on a beam in the form of a concrete beam, FIG. 2 shows using of the beam illustrated in the first embodiment shown FIG. 1 for the second time, FIG. 3 shows a second embodiment where a first end of a first floor element and a second end of a second floor element is supported on a beam in the form of a concrete beam in a situation where the beam is used for the first time, FIG. 4 shows using of the beam illustrated in the second embodiment in FIG. 3 for the second time, FIG. 5 shows a third embodiment where a first end of a first floor element is supported on a beam in the form of a concrete beam, FIG. 6 shows using of the beam illustrated in the third embodiment in FIG. 5 for the second time, FIG. 7 shows a fourth embodiment where a first end of a first floor element is supported on a beam in the form of a concrete beam in a situation where the beam is used for the first time, FIG. 8 shows using of the beam illustrated in the fourth embodiment in FIG. 7 for the second time, FIG. 9 shows a fifth embodiment where a first end of a first floor element and a second end of a second floor element is supported on a beam in the form of a steel-concrete composite beam, FIG. 10 shows using of the beam illustrated in the fifth embodiment in FIG. 9 for the second time, FIG. 11 shows a sixth embodiment where a first end of a first floor element is supported on a beam in the form of a steel-concrete composite beam in a situation where the beam is used for the first time, FIG. 12 shows using of the beam illustrated in the sixth embodiment in FIG. 11 for the second time, FIG. 13 shows a seventh embodiment where a first end of a first floor element is supported on a beam in the form of a steel-concrete composite beam, FIG. 14 shows using of the beam illustrated in the seventh embodiment in FIG. 13 for the second time, FIG. 15 shows an eight embodiment where a first end of a first floor element is supported on a beam in the form of a steel-concrete composite beam in a situation where the beam is used for the first time, FIG. 16 shows using of the beam illustrated in the eight embodiment in FIG. 15 for the second time, FIG. 17 shows a ninth embodiment, which is a variant of the sixth embodiment shown in FIG. 11, FIG. 18 shows a tenth embodiment, which is a variant of the sixth embodiment shown in FIG. 11, FIG. 19 shows a eleventh embodiment, which is a variant of the fifth embodiment shown in FIG. 9, FIG. 20 shows a twelfth embodiment, which is a variant of the sixth embodiment shown in FIG. 11, FIG. 21 shows using of the beam of the twelfth embodiment shown in FIG. 20 is used for the second time, FIG. 22 shows a thirteenth embodiment, where the elongated transverse fitting is in the form of a tube element, FIG. 23 shows using of the beam of the thirteenth embodiment shown in FIG. 22 for the second time, FIG. 24 shows a detail view of a first protective element connected to a first free end of an elongated transverse fitting or of a second protective element connected to a second free end of an elongated transverse fitting, FIG. 25 shows the first protective element or the second protective element as cut along line A-A in FIG. 24, FIG. 26 shows a detail view of a first protective element connected to a first free end of an elongated transverse fitting or of a second protective element connected to a second free end of an elongated transverse fitting, FIG. 27 shows the first protective element or the second protective element as cut along line B-B in FIG. 26, FIG. 28 shows a detail view of a first protective element connected to a first free end of an elongated transverse fitting or of a second protective element connected to a second free end of an elongated transverse fitting, FIG. 29 shows the first protective element or the second protective element as cut along line C-C in FIG. 28, FIG. 30 shows a detail view of a first protective element connected to a first free end of an elongated transverse fitting or of a second protective element connected to a second free end of an elongated transverse fitting, FIG. 31 shows the first protective element or the second protective element as cut along line D-D in FIG. 30, FIG. 32 shows a detail view of a first protective element connected to a first free end of an elongated transverse fitting or of a second protective element connected to a second free end of an elongated transverse fitting, FIG. 33 shows the first protective element or the second protective element as cut along line E-E in FIG. 32, FIG. 34 shows a detail view of a first protective element connected to a first free end of an elongated transverse fitting or of a second protective element connected to a second free end of an elongated transverse fitting, FIG. 35 shows the first protective element or the second protective element as cut along line F-F in FIG. 34, FIG. 36 shows a detail of a fourteenth embodiment, FIG. 37 shows a fifteenth embodiment in as state, where the first space and the second space is unfilled with fill material, FIG. 38 shows the fifteenth embodiment illustrated in FIG. 37 after filling fill material into the first space and the second space, FIG. 39 shows the fifteenth embodiment illustrated in FIG. 38 as cut along line H-H in FIG. 38, FIG. 40 shows the fifteenth embodiment illustrated in FIG. 39 as cut along line G-G in FIG. 38, FIG. 41 shows a sixteenth embodiment, where plate members are arranged to project from the supporting surfaces of the beam, FIG. 42 shows a seventeenth embodiment, where plate members are arranged to project from the supporting surfaces of the beam, FIG. 43 shows an eighteenth embodiment where a first end of a first floor element and a second end of a second floor element is supported on a beam in the form of a steel-concrete composite beam and where the elongated transverse fitting comprises a tube element, FIG. 44 shows using of the beam illustrated in the eighteenth embodiment in FIG. 43 for the second time, FIG. 45 shows an nineteenth embodiment where a first end of a first floor element and a second end of a second floor element is supported on a beam in the form of a steel-concrete composite beam and where the elongated transverse fitting comprises a tube element, FIG. 46 shows using of the beam illustrated in the nineteenth embodiment in FIG. 45 for the second time, FIG. 47 shows detail DET Z of the nineteenth embodiment in FIG. 45 from one side, and FIG. 48 shows detail DET Z of the nineteenth embodiment in FIG. 45 from above.

DETAILED DESCRIPTION OF THE INVENTION

First the method for supporting a first end 1 of a first floor element 2 at a beam 3 that can comprise concrete 11 and some embodiments and variants of the method will be described in greater detail.

The first floor element 2 can for example be a cast in situ or any other type concrete slab, i.e. a hollow-core slab, a filigran type slab, a steel decking, or a wood slab.

In the method the beam 3 is provided with a supporting flange section 4 configured to support said first end 1 of the first floor element 2 and with a web section 5 projecting upwards from the supporting flange section 4

The method comprises supporting said first end 1 of the first floor element 2 on a first supporting surface 6 of the supporting flange section 4 at a first lateral side 9 of the beam 3 so that a first space 7 is formed between the first end 1 of the first floor element 2 and the web section 5 of the beam 3. FIGS. 5 to 8 and 13 to 16 shows embodiments, where the supporting flange section 4 of the beam 3 has only a first supporting surface 6. FIGS. 1 to 4, 9 to 12, 17 to 23 and 40 to 42 shows embodiments, where the supporting flange section 4 of the beam 3 has a first supporting surface 6 and a second supporting surface 22.

The method comprises providing elongated transverse fittings 10 in the web section 5 of the beam 3.

The method comprises arranging first transverse reinforcements 8 to extend between the first lateral side 9 of the beam 3 and the inside of the first floor element 2.

The method comprises filling fill material 17 in the first space 7 between the first end 1 of the first floor element 2 and the web section 5 of the beam 3 and possible also into voids 42 in the first floor element 2 and/or into a beam space 36 the beam 3 and possible also between two adjacent first floor elements 2 and possible also in the elongated transverse fittings.

The fill material 17 can for example comprise at least one of cement-based material such as concrete, cement mortar, or grout, and other type of filler such as lime mortar, or gypsum.

The method comprises providing the elongated transverse fittings 10 to have a first free end 13 at the first lateral side 9 of the web section 2 of the beam 3.

The method can comprise providing the first free end 13 of the elongated transverse fittings 10 to project at least partly out from the web section 2 of the beam 3 at the first lateral side 9 of the beam 3.

The method comprises connecting a first protective element 14 to the first free end 13 of the elongated transverse fitting 10 outside the web section 5 of the beam 3.

The purpose of the first protective element 14 is to firstly to protect the first free end 13 of the elongated transverse fitting 10 in the fill material 17 that is filled at least in the first space 7 between the first end 1 of the first floor element 2 and the web section 5 of the beam 3 so that it is possible to use the elongated transverse fitting 10 as a connection means between the beam 3 and another first floor element (not marked with a reference numeral) in case the first floor element 2 is detached from the beam 3 to reuse the beam 3 as a building element in another place in the same building or in another building and secondly to allow finding of and protecting the elongated transverse fitting 10 in the building structure when there is a need to detach the first floor element 2 from the beam 3 in such way that detaching of the first floor element 2 from the beam 3 can be performed without damaging elongated transverse fitting 10.

In the method, the transverse reinforcements 8 can be arranged to extend in parallel or alongside with the elongated transverse fittings 10 and separated from the elongated transvers fittings 10 and providing the first free end 13 of the elongated transverse fittings 10 with a first threaded coupler 15, as shown in FIGS. 3, 7, 11, and 15. In such case, the first protective elements 14 can be arranged to at least partly surround the first threaded couplers 15 as shown in FIGS. 3, 7, 11, and 15.

In each of the second embodiment shown in FIG. 3, the fourth embodiment shown in FIG. 7, the sixth embodiment shown in FIG. 11, and the eight embodiment shown in FIG. 15, the first floor element 2 can be separated from the beam 3 by cutting along a cutting plane 41A outside the beam 3 and through the fill material 17 filled between the first lateral side 9 of the beam 3 and the first end 1 of the first floor element 2, or by cutting along a cutting plane 41B through the first floor element 2 in the vicinity of the first end 1 of the first floor element. In both situations, the first transverse reinforcement 8 will also be cut. In case the fill material 17 is for example a cement-based material, separation is preferably done by cutting. In case the fill material 17 is lime mortar, gypsum or the like, the separation can at least partly be made by washing so that only the first transverse reinforcements 8 are cut. After such separation of the first floor element 2 from the beam 3 by cutting, the beam 3 can be reused as a component in the same building structure from which the beam 3 was detached or as a component in another building structure as is illustrated in FIGS. 4, 8, 12 and 16, where the first threaded coupler 15 provided at the first free end 13 of the elongated transverse fittings 10 in the beam 3 serves as means for connecting the beam 3 and another first floor element (not marked with a reference numeral) by means of a secondary transverse reinforcement 12 extending between the first lateral side 9 of the beam and the inside of said another first floor element. It is also possible to reuse the first floor element 2 as a component in the same building structure from which the first floor element 2 was detached or as a component in another building structure.

In the method, the elongated transverse fittings 10 can comprise a tube element 35, and the method can comprise arranging the transverse reinforcements 8 partly inside the tube element 35 as shown in FIGS. 22 and 23. In such case, the first protective elements 14 can be arranged to at least partly surround the transverse reinforcements 8 as shown in FIGS. 22 and 23 and in FIGS. 43, 45, 47 and 48. The tube elements 35 can for example have a round, an oval, a square, or a rectangular cross-section.

In the thirteenth embodiment shown in FIG. 22 and in the fourteenth embodiment shown in FIG. 23 the first floor element 2 can be separated from the beam 3 by cutting along a cutting plane 41A outside the beam 3 and through the fill material 17 filled between the first lateral side 9 of the beam 3 and the first end 1 of the first floor element 2, or by cutting along a cutting plane 41B through the first floor element 2 in the vicinity of the first end 1 of the first floor element. In both situations, the first transverse reinforcement 8 will also be cut. After such separation of the first floor element 2 from the beam 3 by cutting, the beam 3 can be reused as a component in the same building structure from which the beam 3 was detached or as a component in another building structure so that the cut first transverse reinforcement 8 is removed from the tube element 35 and replaced with a secondary transverse reinforcement 12.

The method can comprise providing the first free end 13 of the elongated transverse fittings 10 with a first threaded coupler 15, and connecting the first transverse reinforcements 8 to the threads of the first threaded coupler 15 as shown in FIGS. 1, 5, 9, 13 and 19. In such case, the first protective elements 14 can be arranged to at least partly surround the first threaded couplers 15 and/or the transverse reinforcements 8 as shown in FIGS. 1, 5, 9, 13 and 19.

In each of the first embodiment shown in FIG. 1, the third embodiment shown in FIG. 5, the fifth embodiment shown in FIG. 9, and the seventh embodiment shown in FIG. 13, the first floor element 2 can be separated from the beam 3 by cutting along a cutting plane 41A outside the beam 3 and through the fill material 17 filled between the first lateral side 9 of the beam 3 and the first end 1 of the first floor element 2, or by cutting along a cutting plane 41B through the first floor element 2 in the vicinity of the first end 1 of the first floor element. In both situations, the first transverse reinforcement 8 will also be cut. After such separation of the first floor element 2 from the beam 3 by cutting, the beam 3 can be reused as a component in the same building structure from which the beam 3 was detached or as a component in another building structure as is illustrated in FIGS. 2, 6, 10 and 14, where cut first transverse reinforcement 8 has been removed from the first threaded coupler 15 and the first threaded coupler 15 provided at the first free end 13 of the elongated transverse fittings 10 in the beam 3 serves as means for connecting the beam 3 and another first floor element (not marked with a reference numeral) by means of a secondary transverse reinforcement 12 extending between the first lateral side 9 of the beam 3 and the inside of said another first floor element.

If the method comprises providing the first free end 13 of the elongated transverse fittings 10 with a first threaded coupler 15, the method comprises preferably anchoring the first threaded coupler 15 in concrete in the beam 3 by means of an anchoring element 16 of the elongated transverse fittings 10 connected to the first threaded coupler 15. In such embodiment the method can comprise providing the first threaded coupler 15 comprising one of a female connector with a blind hole provided with an inner threading and a male connector with a rod section provided with an outer threading.

The beam 3 that is used in the method can be a concrete beam 3, as shown in FIGS. 1 to 8. The beam 3 that is used in the method can also be a steel beam (not shown in the figures).

The beam 3 that is used in the method can be a steel-concrete composite beam 3, as shown in FIGS. 9 to 23, where the supporting flange section 4 of the beam 3 is a bottom plate of steel 18, and where the web section 5 of the beam 3 comprising a first web plate of steel 19 connected to the bottom plate of steel 18, a second web plate of steel 20 connected to the bottom plate of steel 18, and concrete casted in a beam space 36 between the first web plate of steel 19 and the second web plate of steel 20. In such embodiment of the method, the method can comprise fastening the elongated transverse fittings 10 to the steel-concrete composite beam 3 such as to at least one the first web plate of steel 19 and the second web plate of steel 20. In such embodiment of the method, the first web plate of steel 19 and/or the second web plate of steel 20 comprises can have openings 21, and method can comprise forming at least some of the elongated transverse fittings 10 at least partly by the openings 21 in the first web plate of steel 19 and/or in the second web plate of steel 20. If the beam 3 that is used in the method is a steel-concrete composite beam 3, the beam can additionally comprise a top plate of steel 32. If the beam 3 that is used in the method is a steel-concrete composite beam 3 comprising a top plate of steel 32, the top plate of steel 32 can comprise at least one of air openings 33 for allowing air to escape the beam space 36 when the beam space is filled with concrete 11 and threaded studs 34 which can be used for lifting the beam 3.

The supporting flange section 4 of the beam 3 that is used in the method can additionally be provided with a second supporting surface 22 at a second lateral side 23 of the beam 3 as shown in FIGS. 1 to 4, 9 to 12, 17 to 23 and 37 to 42. In such embodiment of the method, the method comprises supporting a second end 24 of a second floor element 25 on the second supporting surface 22 of the supporting flange section 4 of the beam 3 so that a second space 26 is formed between the second end 24 of the second floor element 25 and the web section 5 of the beam 3. In such embodiment of the method, the method comprises arranging elongated transverse reinforcements 8 to additionally extend between the second lateral side 23 of the beam 3 and the inside of the second floor element 25. In such embodiment of the method, the method comprises filling fill material 17 in the second space 26 between the second end 24 of the second floor element 25 and the web section 5 of the beam 3. In such embodiment of the method, the method comprises arranging the elongated transverse fittings 10 to have a second free end 27 at second lateral side 23 of the web section 5 of the beam 3. In such embodiment of the method, the method can comprise arranging the elongated transverse fittings 10 so that the second free end 27 elongated transverse fittings 10 project at least partly out from the beam 3 at second lateral side 23 of the web section 5 of the beam 3. In such embodiment of the method, the method comprises connecting a second protective element 28 to the second free end 27 of the elongated transverse fittings 10 outside the web section 5 of the beam 3. The purpose of the second protective element 28 is basically same as the purpose of the first protective element 14. In such embodiment of the method, the method can comprise arranging a possible second transverse reinforcement 12 to additionally extend out of the beam 3 at the second lateral side 23 of the beam 3 and into the second floor element 25. In such embodiment of the method, the method can comprise providing the second free end 27 of the elongated transverse fittings 10 with a second threaded coupler 29, and connecting the elongated transverse reinforcements 8 to the threads of the second threaded coupler 29. In such embodiment of the method, the method can comprise providing a second threaded coupler 29 comprising one of a female connector with a blind hole provided with an inner threading and a male connector with a rod section provided with an outer threading. In such embodiment of the method, the method can comprise selecting the length of the second protective element 28 so that the second protective element 28 does not extend in the lateral direction into the second floor element 25. An advantage is that the second protective element 28 can easily be found, but saves material by not being unnecessary long. In such embodiment of the method, the method can however comprise selecting the length of the second protective element 28 so that the second protective element 28 extend in the lateral direction into the second floor element 25

In the second embodiment shown in FIG. 3 and the sixth embodiment shown in FIG. 11, the second floor element 25 can be separated from the beam 3 by cutting along a cutting plane 41C outside the beam 3 and through the fill material 17 filled between the second lateral side 23 of the beam 3 and the second end 24 of the second floor element 25, or by cutting along a cutting plane 41D through the second floor element 25 in the vicinity of the second end 24 of the second floor element. In both situations, the first transverse reinforcement 8 will also be cut. After such separation of the second floor element 2 from the beam 3 by cutting, the beam 3 can be reused as a component in the same building structure from which the beam 3 was detached or as a component in another building structure as is illustrated in FIGS. 4 and 12, where the second threaded coupler 29 provided at the second free end 27 of the elongated transverse fittings 10 in the beam 3 serves as means for connecting the beam 3 and another second floor element (not marked with a reference numeral) by means of a secondary transverse reinforcement 12 extending between the second lateral side 23 of the beam 3 and the inside of said another second floor element.

In the first embodiment shown in FIG. 1 and the fifth embodiment shown in FIG. 9, the second floor element 25 can be separated from the beam 3 by cutting along a cutting plane 41C outside the beam 3 and through the fill material 17 filled between the second lateral side 23 of the beam 3 and the second end 24 of the second floor element 25, or by cutting along a cutting plane 41D through the second floor element 25 in the vicinity of the second end 24 of the second floor element 28. In both situations, the first transverse reinforcement 8 will also be cut. After such separation of the second floor element 25 from the beam 3 by cutting, the beam 3 can be reused as a component in the same building structure from which the beam 3 was detached or as a component in another building structure as is illustrated in FIGS. 2 and 10, where cut first transverse reinforcement 8 has been removed from the second threaded coupler 29 and the second threaded coupler 29 provided at the second free end 27 of the elongated transverse fittings 10 in the beam 3 serves as means for connecting the beam 3 and another second floor element (not marked with a reference numeral) by means of a secondary transverse reinforcement 12 extending between the second lateral side 23 of the beam 3 and the inside of said another second floor element.

The second floor element 25 can for example be a concrete slab, a hollow-core slab, a filigran type slab, a steel decking, or a wood slab.

The method comprises preferably, but not necessarily, selecting the length of the first protective element 14 so that the first protective element 14 does not extend in the lateral direction into the first floor element 2. An advantage is that the first protective element 14 can easily be found, but saves material by not being unnecessary long. The method can also comprise selecting the length of the first protective element 14 so that the first protective element 14 extend in the lateral direction into the first floor element 2.

The method comprises preferably, but not necessarily, providing first protective elements 14 made of at least one of elastically deformable material such as of polymer, plastic, rubber of a combination thereof, and biodegradable material such as of wood. The first protective element 14 that is used in the method can have an outer covering 37 that is made of softer or more flexible material than an inner core 38 of the protective element as illustrated in FIGS. 24 to 27 and 30 and 31 because of the outer covering 37 that is made of softer or more flexible material, the first protective element 14 can easily be detached from the first free end 13 of the elongated transverse fitting 10 when the beam 3 is separated from the first floor element 2 even in a situation where fill material 17 remains attached to the beam 3. In FIGS. 24 and 25 the first protective element 14 is additionally provided with a hexagonal end 39 for a hexagonal tool (not illustrated) to facilitate screwing of the first protective element 14 off the first threaded coupler 15 of the elongated transverse fitting 10. The first protective element 14 that is used in the method can also be provided with cavities 40 as illustrated in FIGS. 32 to 35 to make it easier to separate the first protective element 14 from the first free end 13 of the elongated transverse fitting 10 when the beam 3 is separated from the first floor element 2 even in a situation where fill material 17 remains attached to the beam 3. Such cavities 40 improves deformability of the first threaded coupler 15. The possible second protective elements 28 can be formed in the same way as the first protective elements 14.

The method comprises preferably, but not necessarily, covering the beam 3 at least partly with a covering 30 to prevent fill material 17 from adhering to the beam 3, as illustrated in FIGS. 39 to 41. The advantage of this is that this makes it easier to separate the beam 3 from the first floor element 2 and the possible second floor element 25. The covering 30 can for example be oil, polymer, plastic, rubber or a combination thereof.

The method comprises preferably, but not necessarily, providing a vertical plate member 31 to project from the first supporting surface 6 of the supporting flange section 4 of the beam 3 between the web section 5 of the beam 3 and the first end 1 of the first floor element 2 to divide the fill material 17 in the first space 7 into at least two fill material sections separated by the vertical plate member 31, as illustrated in FIGS. 41 and 42. This allows to use a different fill materials 17 in one of the fill material section than in the other fill material section. It is for example to provide fill material in the form of concrete between the vertical plate member 31 and the first end 1 of the first floor element 2 and to provide fill material in the form of lime mortar, gypsum or the like between the vertical plate member 31 and the web section 5 of the beam 3. Because lime mortar or gypsum is more fragile than concrete, separation of fill material 17 from the beam 3 becomes easier. If the beam 3 that is used in the method has a supporting flange section 4 with both a first supporting surface 6 and a second supporting surface 22, the method comprises preferably, but not necessarily, providing a vertical plate member 31 to project from the first supporting surface 6 of the supporting flange section 4 of the beam 3 between the web section 5 of the beam 3 and the first end 1 of the first floor element 2 to divide the fill material 17 in the first space 7 into at least two fill material sections separated by the vertical plate member 31 and providing a vertical plate member 31 to project from the second supporting surface 22 of the supporting flange section 4 of the beam 3 between the web section 5 of the beam 3 and the second end 24 of the second floor element 25 to divide the fill material 17 in the second space 26 into at least two fill material sections separated by the vertical plate member 31, as illustrated in FIGS. 41 and 42. In the eighteenth embodiment illustrated in FIG. 43 and in the nineteenth embodiment illustrated in FIG. 45, a vertical plate member 31 is provided to project from the first supporting surface 6 of the supporting flange section 4 of the beam 3 between the web section 5 of the beam 3 and the first end 1 of the first floor element 2 to divide the fill material 17 in the first space 7 into at least two fill material sections separated by the vertical plate member 31 and a vertical plate member 31 is provided to project from the second supporting surface 22 of the supporting flange section 4 of the beam 3 between the web section 5 of the beam 3 and the second end 24 of the second floor element 25 to divide the fill material 17 in the second space 26 into at least two fill material sections separated by the vertical plate member 31. In the eighteenth embodiment illustrated in FIG. 43 and in the nineteenth embodiment illustrated in FIG. 45, the elongated transverse fitting 10 comprises a tube element 35 that penetrates through both vertical plate members 31 and the beam. In the eighteenth embodiment illustrated in FIG. 43, the first transverse reinforcement 8 is in one-piece form so that the first transverse reinforcement 8 extend from the inside first floor element 2 through the beam 3 in the tube element 35 into the second floor element 25. In the nineteenth embodiment illustrated in FIG. 45, the first transverse reinforcement 8 is in two-piece form so that one first transverse reinforcement 8 extend from the inside of the first floor element 2 through the beam 3 in the tube element 35 and through the vertical plate member 31 so that it said one first transverse reinforcement 8 is tightened against the vertical plate 31 by means of a nut 45 threaded to an end threading (not marked with a reference numeral) of said one first transverse reinforcement 8 and so that another first transverse reinforcement 8 extend from the inside of the second floor element 25 through the beam 3 in the tube element 35 in parallel with said one first transverse reinforcement 8 and through the vertical plate member 31 so that it said another first transverse reinforcement 8 is tightened against the vertical plate 31 by means of a nut 45 threaded to an end threading (not marked with a reference numeral) of said another first transverse reinforcement 8

It is also possible to arrange a pair of vertical separation members 43 between adjacent first floor elements 2 and/or between adjacent second floor elements 25 so as to provide a third space 44 for fill material 17 between the vertical separation members 43 made for example of metal or plastic and to provide the first transverse reinforcement 8 in said third space as in the fifteenth illustrated in FIGS. 37 to 41. An advantage of this is that this allows to use for example lime mortar, gypsum or the like as the fill material 17 between the vertical separation members 43. As lime mortar, gypsum, or the like is easier to remove than concrete, allows the fifteenth embodiment also for easy separation of adjacent first floor elements 2 and/or adjacent second floor elements 25 from each other without damaging the floor elements and this allows for reuse of the floor elements.

Next the arrangement for supporting a first end 1 of a first floor element 2 at a beam 3 that can comprise and some embodiments and variants of the arrangement will be described in greater detail.

The first floor element 2 can for example be a concrete slab, a hollow-core slab, a filigran type slab, a steel decking, or a wood slab.

In the arrangement the beam 3 is provided with a supporting flange section 4 configured to support said first end 1 of the first floor element 2 and with a web section 5 projecting upwards from the supporting flange section 4

In the arrangement said first end 1 of the first floor element 2 is supported on a first supporting surface 6 of the supporting flange section 4 at a first lateral side 9 of the beam 3 so that a first space 7 is formed between the first end 1 of the first floor element 2 and the web section 5 of the beam 3. FIGS. 5 to 8 and 13 to 16 shows embodiments, where the supporting flange section 4 of the beam 3 has only a first supporting surface 6. FIGS. 1 to 4, 9 to 12, 17 to 23 and 37 to 42 shows embodiments, where the supporting flange section 4 of the beam 3 has a first supporting surface 6 and a second supporting surface 22.

In the arrangement elongated transverse fittings 10 are provided in the web section 2 of the beam 3.

In the arrangement elongated transverse reinforcements 8 extend between the first lateral side 9 of the beam 3 and the inside of the first floor element 2.

In the arrangement fill material 17 is filled in the first space 7 between the first end 1 of the first floor element 2 and the web section 5 of the beam 3 and possible also into voids 42 in the first floor element 2 and/or into a beam space 36 of the beam 3 and possible also between two adjacent floor elements 2 and possible also in the elongated transverse fittings.

The fill material 17 can for example comprise at least one of cement-based material such as concrete, cement mortar, or grout or other type of filler such as lime mortar, or gypsum.

In the arrangement the elongated transverse fittings 10 are provided with a first free end 13 at the first lateral side 9 of the beam 3.

The first free end 13 of the elongated transverse fittings 10 can project at least partly out from the web section 2 of the beam 3 at the first lateral side 9 of the beam 3

In the arrangement a first protective element 14 is connected to the first free end 13 of the elongated transverse fitting 10 outside the web section 5 of the beam 3.

The purpose of the first protective element 14 is to firstly to protect the first free end 13 of the elongated transverse fitting 10 in the fill material 17 that is filled at least in the first space 7 between the first end 1 of the first floor element 2 and the web section 5 of the beam 3 so that it is possible to use the elongated transverse fitting 10 as a connection means between the beam 3 and another first floor element (not marked with a reference numeral) in case the first floor element 2 is detached from the beam 3 to reuse the beam 3 as a building element in another place in the same building or in another building and secondly to allow finding of and protecting the elongated transverse fitting 10 in the building structure when there is a need to detach the first floor element 2 from the beam 3 in such way that detaching of the first floor element 2 from the beam 3 can be performed without damaging elongated transverse fitting 10. It is also possible to reuse the first floor element 2 as a component in the same building structure from which the first floor element 2 was detached or as a component in another building structure.

In the arrangement, the transverse reinforcements 8 can extend in parallel with or alongside the elongated transverse fittings 10 and separated from the elongated transvers fittings 10 and the first free end 13 of the elongated transverse fittings 10 can be provided with a first threaded coupler 15, as shown in FIGS. 3, 7, 11, and 15. In such case, the first protective elements 14 can be arranged to at least partly surround the first threaded couplers 15 as shown in FIGS. 3, 7, 11, and 15.

In each of the second embodiment shown in FIG. 3, the fourth embodiment shown in FIG. 7, the sixth embodiment shown in FIG. 11, and the eight embodiment shown in FIG. 15, the first floor element 2 can be separated from the beam 3 by cutting along a cutting plane 41A outside the beam 3 and through the fill material 17 filled between the first lateral side 9 of the beam 3 and the first end 1 of the first floor element 2, or by cutting along a cutting plane 41B through the first floor element 2 in the vicinity of the first end 1 of the first floor element. In both situations, the first transverse reinforcement 8 will also be cut.

After such separation of the first floor element 2 from the beam 3 by cutting, the beam 3 can be reused as a component in the same building structure from which the beam 3 was detached or as a component in another building structure as is illustrated in FIGS. 4, 8, 12 and 16, where the first threaded coupler 15 provided at the first free end 13 of the elongated transverse fittings 10 in the beam 3 serves as means for connecting the beam 3 and another first floor element (not marked with a reference numeral) by means of a secondary transverse reinforcement 12 extending between the first lateral side 9 of the beam and the inside of said another first floor element.

In the arrangement, the elongated transverse fittings 10 can comprises a tube element 35, and the transverse reinforcements 8 can be arranged inside the tube element 35 as illustrated in FIGS. 22 and 23. In such case, the first protective elements 14 can be arranged to at least partly surround the transverse reinforcements 8 as shown in FIGS. 22 and 23. The tube elements 35 can for example have a round, an oval, a square, or a rectangular cross-section.

In the thirteenth embodiment shown in FIG. 22 and in the fourteenth embodiment shown in FIG. 23 the first floor element 2 can be separated from the beam 3 by cutting along a cutting plane 41A outside the beam 3 and through the fill material 17 filled between the first lateral side 9 of the beam 3 and the first end 1 of the first floor element 2, or by cutting along a cutting plane 41B through the first floor element 2 in the vicinity of the first end 1 of the first floor element. In both situations, the first transverse reinforcement 8 will also be cut. After such separation of the first floor element 2 from the beam 3 by cutting, the beam 3 can be reused as a component in the same building structure from which the beam 3 was detached or as a component in another building structure so that the cut first transverse reinforcement 8 is removed from the tube element 35 and replaced with a secondary transverse reinforcement 12.

In the arrangement the first free end 13 of the elongated transverse fittings 10 can be provided with a first threaded coupler 15, and first transverse reinforcements 8 can be connected to the threads of the first threaded coupler 15, as shown in FIGS. 1, 5, 9, 13 and 19. In such case, the first protective elements 14 can be arranged to at least partly surround the first threaded couplers 15 and/or the transverse reinforcements 8 as shown in FIGS. 1, 5, 9, 13 and 19.

In each of the first embodiment shown in FIG. 1, the third embodiment shown in FIG. 5, the fifth embodiment shown in FIG. 9, and the seventh embodiment shown in FIG. 13, the first floor element 2 can be separated from the beam 3 by cutting along a cutting plane 41A outside the beam 3 and through the fill material 17 filled between the first lateral side 9 of the beam 3 and the first end 1 of the first floor element 2, or by cutting along a cutting plane 41B through the first floor element 2 in the vicinity of the first end 1 of the first floor element. In both situations, the first transverse reinforcement 8 will also be cut. In case the fill material 17 is for example a cement-based material, separation is preferably done by cutting. In case the fill material 17 is lime mortar, gypsum, or the like the separation can at least partly be made by washing so that only the first transverse reinforcements 8 are cut. After such separation of the first floor element 2 from the beam 3 by cutting, the beam 3 can be reused as a component in the same building structure from which the beam 3 was detached or as a component in another building structure as is illustrated in FIGS. 2, 6, 10 and 14, where cut first transverse reinforcement 8 has been removed from the first threaded coupler 15 and the first threaded coupler 15 provided at the first free end 13 of the elongated transverse fittings 10 in the beam 3 serves as means for connecting the beam 3 and another first floor element (not marked with a reference numeral) by means of a secondary transverse reinforcement 12 extending between the first lateral side 9 of the beam 3 and the inside of said another first floor element.

If elongated transverse fittings 10 in the arrangement comprises a first threaded coupler 15, the first threaded coupler 15 can be anchored in concrete in the beam 3 by means of an anchoring element 16 of the elongated transverse fittings 10 connected to the first threaded coupler 15. In such embodiments of the arrangement, the first threaded coupler 15 can comprise one of a female connector with a blind hole provided with an inner threading and a male connector with a rod section provided with an outer threading.

The beam 3 can be a concrete beam 3, as shown in FIGS. 1 to 8. The beam 3 that is used in the method can also be a steel beam (not shown in the figures). In the arrangement, the beam 3 can be a steel-concrete composite beam 3, as shown in FIGS. 9 to 23, so that the supporting flange section 4 of the beam 3 is a bottom plate of steel 18, and so that the web section 5 of the beam 3 comprise a first web plate of steel 19 connected to the bottom plate of steel 18, a second web plate of steel 20 connected to the bottom plate of steel 18, and concrete casted in a beam space 36 between the first web plate of steel 19 and the second web plate of steel 20. In such embodiments the elongated transverse fittings 10 can be fastened to the steel-concrete composite beam 3 such as to at least one the first web plate of steel 19 and the second web plate of steel 20. In such embodiments the first web plate of steel 19 and the second web plate of steel 20 can comprise openings 21, and at least some of the elongated transverse fittings 10 can be at least partly by the openings 21 in the first web plate of steel 19 and in the second web plate of steel 20. If the beam 3 is a steel-concrete composite beam 3, the beam 3 can additionally comprise a top plate of steel 32. If the beam 3 is a steel-concrete composite beam 3 comprising a top plate of steel 32, the top plate of steel 32 can comprise at least one of air openings 33 for allowing air to escape the beam space 36 when the beam space is filled with concrete 11 and threaded studs 34 which can be used for lifting the beam 3.

In the arrangement the supporting flange section 4 of the beam 3 can additionally be provided with a second supporting surface 22 at a second lateral side 23 of the beam 33 as shown in FIGS. 1 to 4, 9 to 12, 17 to 23 and 37 to 42. In such embodiments of the arrangement, a second end 24 of a second floor element 25 is supported on the second supporting surface 22 of the supporting flange section 4 of the beam 3 so that a second space 26 is formed between the second end 24 of the second floor element 25 and the web section 5 of the beam 3. In such embodiments of the arrangement the transverse reinforcements 8 are arranged to additionally extend between the second lateral side 23 of the beam 3 and the second floor element 25. In such embodiments of the arrangement fill material 17 is filled in the second space 26 between the second end 24 of the second floor element 25 and the web section 5 of the beam 3. In such embodiments of the arrangement the elongated transverse fittings 10 are arranged to have a second free end 27 at second lateral side 23 of the web section 5 of the beam 3. In such embodiments of the arrangement the second free end 27 of the elongated transverse fittings 10 can project at least partly out from the beam 3 at second lateral side 23 of the web section 5 of the beam 3. In such embodiments of the arrangement a second protective element 28 is connected to the second free end 27 of the elongated transverse fittings 10 outside the web section 5 of the beam 3. The purpose of the second protective element 28 is basically the same as the purpose of the first protective element 14. In such embodiments of the arrangement, the possible second transverse reinforcement 12 can additionally extend out of the beam 3 at the second lateral side 23 of the beam 3 and into the second floor element 25. In such embodiments of the arrangement, the second free end 27 of the elongated transverse fittings 10 can be provided with a second threaded coupler 29, and an elongated transverse reinforcement 8 can be connected to the threads of the second threaded coupler 29. In such embodiments of the arrangement, the second threaded coupler 29 can comprise one of a female connector with a blind hole provided with an inner threading and a male connector with a rod section provided with an outer threading. In such embodiments of the arrangement, the length of the second protective element 28 is preferably, but not necessarily, selected so that the second protective element 28 does not extend in the lateral direction into the second floor element 25. The length of the second protective element 28 can also be selected so that the second protective element 28 extend in the lateral direction into the second floor element 25.

In the second embodiment shown in FIG. 3 and the sixth embodiment shown in FIG. 11, the second floor element 25 can be separated from the beam 3 by cutting along a cutting plane 41C outside the beam 3 and through the fill material 17 filled between the second lateral side 23 of the beam 3 and the second end 24 of the second floor element 25, or by cutting along a cutting plane 41D through the second floor element 25 in the vicinity of the second end 24 of the second floor element. In both situations, the first transverse reinforcement 8 will also be cut. After such separation of the second floor element 2 from the beam 3 by cutting, the beam 3 can be reused as a component in the same building structure from which the beam 3 was detached or as a component in another building structure as is illustrated in FIGS. 4 and 12, where the second threaded coupler 29 provided at the second free end 27 of the elongated transverse fittings 10 in the beam 3 serves as means for connecting the beam 3 and another second floor element (not marked with a reference numeral) by means of a secondary transverse reinforcement 12 extending between the second lateral side 23 of the beam 3 and the inside of said another second floor element.

In the first embodiment shown in FIG. 1 and the fifth embodiment shown in FIG. 9, the second floor element 25 can be separated from the beam 3 by cutting along a cutting plane 41C outside the beam 3 and through the fill material 17 filled between the second lateral side 23 of the beam 3 and the second end 24 of the second floor element 25, or by cutting along a cutting plane 41D through the second floor element 25 in the vicinity of the second end 24 of the second floor element 28. In both situations, the first transverse reinforcement 8 will also be cut. After such separation of the second floor element 25 from the beam 3 by cutting, the beam 3 can be reused as a component in the same building structure from which the beam 3 was detached or as a component in another building structure as is illustrated in FIGS. 2 and 10, where cut first transverse reinforcement 8 has been removed from the second threaded coupler 29 and the second threaded coupler 29 provided at the second free end 27 of the elongated transverse fittings 10 in the beam 3 serves as means for connecting the beam 3 and another second floor element (not marked with a reference numeral) by means of a secondary transverse reinforcement 12 extending between the second lateral side 23 of the beam 3 and the inside of said another second floor element.

The second floor element 25 can for example be a concrete slab, a hollow-core slab, a filigran type slab, a steel decking, or a wood slab.

In the arrangement, the length of the first protective element 14 is preferably, but not necessarily, selected so that the first protective element 14 does not extend in the lateral direction into the first floor element 2. In the arrangement, the length of the first protective element 14 can also be selected so that the first protective element 14 extend in the lateral direction into the first floor element 2

The first protective elements 14 can be made of at least one of elastically deformable material such as of polymer, plastic, rubber of a combination thereof, and biodegradable material such as of wood. The first protective element 14 can have an outer covering 37 that is made of softer or more flexible material than an inner core 38 of the protective element as illustrated in FIGS. 24 to 27 and 30 and 31 because of the outer covering 37 that is made of softer or more flexible material, the first protective element 14 can easily be detached from the first free end 13 of the elongated transverse fitting 10 when the beam 3 is separated from the first floor element 2 even in a situation where fill material 17 remains attached to the beam 3. In FIGS. 24 and 25 the first protective element 14 is additionally provided with a hexagonal end 39 for a hexagonal tool (not illustrated) to facilitate screwing of the first protective element 14 off the first threaded coupler 15 of the elongated transverse fitting 10. The first protective element 14 can also be provided with cavities 40 as illustrated in FIGS. 32 to 35 to make it easier to separate the first protective element 14 from the first free end 13 of the elongated transverse fitting 10 when the beam 3 is separated from the first floor element 2 even in a situation where fill material 17 remains attached to the beam 3. Such cavities 40 improves deformability of the first threaded coupler 15. The possible second protective elements 28 can have the same configurations as the first protective elements 14 and as presented above.

In the arrangement the beam 3 is preferably, but not necessarily, at least partly covered with a covering 30 to prevent fill material 17 from adhering to the beam 3, as illustrated in FIGS. 39 to 41. The advantage of this is that this makes it easier to separate the beam 3 from the first floor element 2 and the possible second floor element 25. The covering 30 can for example be oil, polymer, plastic, rubber or a combination thereof.

In the arrangement a vertical plate member 31 projecting from the first supporting surface 6 of the supporting flange section 4 of the beam 3 is preferably, but not necessarily, provided between the web section 5 of the beam 3 and the first end 1 of the first floor element 2 to divide the fill material 17 in the first space 7 into at least two fill material sections separated by the vertical plate member 31 as illustrated in FIGS. 41 and 42. This allows to use a different fill materials 17 in one of the fill material section than in the other fill material section. It is for example to provide fill material in the form of concrete between the vertical plate member 31 and the first end 1 of the first floor element 2 and to provide fill material in the form on lime mortar between the vertical plate member 31 and the web section 5 of the beam 3. Because lime mortar, gypsum, or the like is more fragile than concrete, separation of fill material 17 from the beam 3 becomes easier. If the beam 3 has a supporting flange section 4 with both a first supporting surface 6 and a second supporting surface 22, a vertical plate member 31 is preferably, but not necessarily, provided to project from the first supporting surface 6 of the supporting flange section 4 of the beam 3 between the web section 5 of the beam 3 and the first end 1 of the first floor element 2 to divide the fill material 17 in the first space 7 into at least two fill material sections separated by the vertical plate member 31 and a vertical plate member 31 is preferably, but not necessarily, provided to project from the second supporting surface 22 of the supporting flange section 4 of the beam 3 between the web section 5 of the beam 3 and the second end 24 of the second floor element 25 to divide the fill material 17 in the second space 26 into at least two fill material sections separated by the vertical plate member 31, as illustrated in FIGS. 41 and 42.

In the eighteenth embodiment illustrated in FIG. 43 and in the nineteenth embodiment illustrated in FIG. 45, a vertical plate member 31 is provided to project from the first supporting surface 6 of the supporting flange section 4 of the beam 3 between the web section 5 of the beam 3 and the first end 1 of the first floor element 2 to divide the fill material 17 in the first space 7 into at least two fill material sections separated by the vertical plate member 31 and a vertical plate member 31 is provided to project from the second supporting surface 22 of the supporting flange section 4 of the beam 3 between the web section 5 of the beam 3 and the second end 24 of the second floor element 25 to divide the fill material 17 in the second space 26 into at least two fill material sections separated by the vertical plate member 31. In the eighteenth embodiment illustrated in FIG. 43 and in the nineteenth embodiment illustrated in FIG. 45, the elongated transverse fitting 10 comprises a tube element 35 that penetrates through both vertical plate members 31 and the beam. In the eighteenth embodiment illustrated in FIG. 43, the first transverse reinforcement 8 is in one-piece form so that the first transverse reinforcement 8 extend from the inside first floor element 2 through the beam 3 in the tube element 35 into the second floor element 25. In the nineteenth embodiment illustrated in FIG. 45, the first transverse reinforcement 8 is in two-piece form so that one first transverse reinforcement 8 extend from the inside of the first floor element 2 through the beam 3 in the tube element 35 and through the vertical plate member 31 so that it said one first transverse reinforcement 8 is tightened against the vertical plate 31 by means of a nut 45 threaded to an end threading (not marked with a reference numeral) of said one first transverse reinforcement 8 and so that another first transverse reinforcement 8 extend from the inside of the second floor element 25 through the beam 3 in the tube element 35 in parallel with said one first transverse reinforcement 8 and through the vertical plate member 31 so that it said another first transverse reinforcement 8 is tightened against the vertical plate 31 by means of a nut 45 threaded to an end threading (not marked with a reference numeral) of said another first transverse reinforcement 8.

It is also possible that a pair of vertical separation members 43 is arranged between adjacent first floor elements 2 and/or between adjacent second floor elements 25 so as to provide a third space 44 for fill material 17 between the vertical separation members 43 and to provide the first transverse reinforcement 8 in said third space as in the fifteenth illustrated in FIGS. 37 to 41. An advantage of this is that this allows to use for example lime mortar, gypsum, or the like as the fill material 17 between the vertical separation members 43. As lime mortar, gypsum, or the like is easier to remove than concrete, allows the fifteenth embodiment also for easy separation of adjacent first floor elements 2 and/or adjacent second floor elements 25 from each other without damaging the floor elements and this allows for reuse of the floor elements.

Next the beam 1 for supporting a first end 1 of a first floor element 2 some embodiments and variants of the beam 1 will be described in greater detail.

The beam 3 is provided with a supporting flange section 4 configured to support said first end 1 of the first floor element 2 and a web section 5 projecting upwards from the supporting flange section 4.

The first floor element 2 can for example be a concrete slab, a hollow-core slab, a filigran type slab, a steel decking, or a wood slab.

The supporting flange section 4 of the beam 3 comprises a first supporting surface 6 at a first lateral side 9 of the beam 3 and configured to support said first end 1 of said first floor element 2 so that a first space 7 is formed between said first end 1 of said first floor element 2 and the supporting flange section 4 of the beam 3. FIGS. 5 to 8 and 13 to 16 shows embodiments, where the supporting flange section 4 of the beam 3 has only a first supporting surface 6. FIGS. 1 to 4, 9 to 12, 17 to 23 and 37 to 42 shows embodiments, where the supporting flange section 4 of the beam 3 has a first supporting surface 6 and a second supporting surface 22.

The web section 5 of the beam 3 comprises elongated transverse fittings 10 provided in the web section 5 of the beam 3 and configured to receive secondary transverse reinforcements 12 configured to extend between the first lateral side 9 of the beam 3 and the inside of said first floor element 2 supported on the first supporting surface 6 of the supporting flange section 4 of the beam 3.

The elongated transverse fittings 10 are provided with first free end 13 at the first lateral side 9 of the beam 3.

The first free end 13 of the elongated transverse fittings 10 are can projects at least partly out from the web section 2 of the beam 3 at the first lateral side 9 of the beam 3.

A first protective element 14 is connected to the first free end 13 of the elongated transverse fitting 10 outside the web section 5 of the beam 3.

The purpose of the first protective element 14 is to firstly to protect the first free end 13 of the elongated transverse fitting 10 in fill material 17 that is filled at least in the first space 7 between the first end 1 of the first floor element 2 and the web section 5 of the beam 3 and possible also into voids 42 in the first floor element 2 and/or into the beam 3 so that it is possible to use the elongated transverse fitting 10 as a connection means between the beam 3 and another first floor element (not marked with a reference numeral) in case the first floor element 2 is detached from the beam 3 to reuse the beam 3 as a building element in another place in the same building or in another building and secondly to allow finding of and protecting the elongated transverse fitting 10 in the building structure when there is a need to detach the first floor element 2 from the beam 3 in such way that detaching of the first floor element 2 from the beam 3 can be performed without damaging elongated transverse fitting 10.

In the beam, the transverse reinforcements 8 can extend in parallel with or alongside the elongated transverse fittings 10 and separated from the elongated transvers fittings 10 and the first free end 13 of the elongated transverse fittings 10 can be provided with a first threaded coupler 15, as shown in FIGS. 3, 7, 11, and 15. In such case, the first protective elements 14 can be arranged to at least partly surround the first threaded couplers 15 as shown in FIGS. 3, 7, 11, and 15.

In each of the first embodiment shown in FIG. 1, the third embodiment shown in FIG. 5, the fifth embodiment shown in FIG. 9, and the seventh embodiment shown in FIG. 13, the first floor element 2 can be separated from the beam 3 by cutting along a cutting plane 41A outside the beam 3 and through the fill material 17 filled between the first lateral side 9 of the beam 3 and the first end 1 of the first floor element 2, or by cutting along a cutting plane 41B through the first floor element 2 in the vicinity of the first end 1 of the first floor element. In both situations, the first transverse reinforcement 8 will also be cut. After such separation of the first floor element 2 from the beam 3 by cutting, the beam 3 can be reused as a component in the same building structure from which the beam 3 was detached or as a component in another building structure as is illustrated in FIGS. 2, 6, 10 and 14, where cut first transverse reinforcement 8 has been removed from the first threaded coupler 15 and the first threaded coupler 15 provided at the first free end 13 of the elongated transverse fittings 10 in the beam 3 serves as means for connecting the beam 3 and another first floor element (not marked with a reference numeral) by means of a secondary transverse reinforcement 12 extending between the first lateral side 9 of the beam 3 and the inside of said another first floor element.

In the beam, the elongated transverse fittings 10 can comprises tube elements 35, and the tube elements 35 can be configured to receive the transverse receive the elongated transverse reinforcements 8 as shown in FIGS. 22 and 23. In such case, the first protective elements 14 can be arranged to at least partly surround the transverse reinforcements 8 as shown in FIGS. 22 and 23. The tube elements 35 can for example have a round, an oval, a square, or a rectangular cross-section.

In the thirteenth embodiment shown in FIG. 22 and in the fourteenth embodiment shown in FIG. 23 the first floor element 2 can be separated from the beam 3 by cutting along a cutting plane 41A outside the beam 3 and through the fill material 17 filled between the first lateral side 9 of the beam 3 and the first end 1 of the first floor element 2, or by cutting along a cutting plane 41B through the first floor element 2 in the vicinity of the first end 1 of the first floor element. In both situations, the first transverse reinforcement 8 will also be cut. After such separation of the first floor element 2 from the beam 3 by cutting, the beam 3 can be reused as a component in the same building structure from which the beam 3 was detached or as a component in another building structure so that the cut first transverse reinforcement 8 is removed from the tube element 35 and replaced with a secondary transverse reinforcement 12.

In the beam 3, the first free end 13 of the elongated transverse fittings 10 can be provided with a first threaded coupler 15, and the elongated transverse reinforcements 8 can be connected to the threads of the first threaded coupler 15 as shown in FIGS. 1, 5, 9, 13, and 19. In such case, the first protective elements 14 can be arranged to at least partly surround the first threaded couplers 15 and/or the transverse reinforcements 8 as shown in FIGS. 1, 5, 9, 13 and 19.

In each of the first embodiment shown in FIG. 1, the third embodiment shown in FIG. 5, the fifth embodiment shown in FIG. 9, and the seventh embodiment shown in FIG. 13, the first floor element 2 can be separated from the beam 3 by cutting along a cutting plane 41A outside the beam 3 and through the fill material 17 filled between the first lateral side 9 of the beam 3 and the first end 1 of the first floor element 2, or by cutting along a cutting plane 41B through the first floor element 2 in the vicinity of the first end 1 of the first floor element. In both situations, the first transverse reinforcement 8 will also be cut. After such separation of the first floor element 2 from the beam 3 by cutting, the beam 3 can be reused as a component in the same building structure from which the beam 3 was detached or as a component in another building structure as is illustrated in FIGS. 2, 6, 10 and 14, where cut first transverse reinforcement 8 has been removed from the first threaded coupler 15 and the first threaded coupler 15 provided at the first free end 13 of the elongated transverse fittings 10 in the beam 3 serves as means for connecting the beam 3 and another first floor element (not marked with a reference numeral) by means of a secondary transverse reinforcement 12 extending between the first lateral side 9 of the beam 3 and the inside of said another first floor element.

If the elongated transverse fittings 10 comprises first threaded couplers 15, the first threaded couplers 15 can be anchored in concrete of the beam 3 by means of an anchoring element 16 of the elongated transverse fittings 10 connected to the first threaded coupler 15. In such embodiments of the beam 3, the first threaded coupler 15 can comprise one of a female connector with a blind hole provided with an inner threading and a male connector with a rod section provided with an outer threading.

The beam 3 can be a concrete beam 3, as shown in FIGS. 1 to 8. The beam 3 that is used in the method can also be a steel beam (not shown in the figures).

The beam 3 can be a steel-concrete composite beam 3 so that the supporting flange section 4 of the beam 3 is a bottom plate of steel 18, and so that the web section 5 of the beam 3 comprises a first web plate of steel 19 connected to the bottom plate of steel 18, a second web plate of steel 20 connected to the bottom plate of steel 18, and concrete casted in a beam space 36 between the first web plate of steel 19 and the second web plate of steel 20. In such embodiments of the beam 3, the elongated transverse fittings 10 can be fastened to the steel-concrete composite beam 3 such as to at least one the first web plate of steel 19 and the second web plate of steel 20. In such embodiments of the beam 3, the first web plate of steel 19 and the second web plate of steel 20 can comprise openings 21, and at least some of the elongated transverse fittings 10 can be at least partly by the openings 21 in the first web plate of steel 19 and in the second web plate of steel 20. If the beam 3 is a steel-concrete composite beam 3, the beam 3 can additionally comprise a top plate of steel 32. If the beam 3 is a steel-concrete composite beam 3 comprising a top plate of steel 37, the top plate of steel 32 can comprise at least one of air openings 33 for allowing air to escape the beam space 36 when the beam space is filled with concrete 11 and threaded studs 34 which can be used for lifting the beam 3.

The supporting flange section 4 of the beam 3 can additionally be provided with a second supporting surface 22 at a second lateral side 23 of the beam 3 and configured for supporting a second end 24 of a second floor element 25 so that a second space 26 is formed between the second end 24 of the second floor element 25 and the web section 5 of the beam 3 as shown in FIGS. 1 to 3, 7 to 9, 13 to 19, and 33 to 39. In such embodiments of the beam 3, the elongated transverse fittings 10 in the web section 5 of the beam 3 are configured to receive the first transverse reinforcements 8 so that the first transverse reinforcements 8 can additionally extend between the second lateral side 23 of the beam 3 and the inside of said second floor element 25 supported on the second supporting surface 22 of the supporting flange section 4 of the beam 3. In such embodiments of the beam 3, the elongated transverse fittings 10 are arranged to have a second free end 27 at second lateral side 23 of the web section 5 of the beam 3. In such embodiments of the beam 3, the second free end 27 of the elongated transverse fittings 10 can project at least partly out from the beam 3 at second lateral side 23 of the web section 5 of the beam 3. In such embodiments of the beam 3, a second protective element 28 is connected to the second free end 27 of the elongated transverse fittings 10 outside the web section 5 of the beam. The purpose of the second protective element 28 is basically the same as the purpose of the first protective element 14. In such embodiments of the beam 3, the possible second transverse reinforcements 12 can additionally extend out of the beam 3 at the second lateral side 23 of the beam 3 and be configured to extend into said second floor element 25 supported on the second supporting surface 22 of the supporting flange section 4 of the beam 3. In such embodiments of the beam 3, the second free end 27 of the elongated transverse fittings 10 can be provided with a second threaded coupler 29, and the threads of the second threaded coupler 29 can be configured to receive a first reinforcement 8. In such embodiments of the beam 3, the second threaded coupler 29 can comprise one of a female connector with a blind hole provided with an inner threading and a male connector with a rod section provided with an outer threading. In such embodiments of the beam 3, the length of the second protective element 28 is preferably, but not necessarily, selected so that the second protective element 28 does not extend in the lateral direction beyond the supporting flange section 4 of the beam 3. The length of the second protective element 28 can also be selected so that the second protective element 28 extend in the lateral direction beyond the supporting flange section 4 of the beam 3.

In the second embodiment shown in FIG. 3 and the sixth embodiment shown in FIG. 11, the second floor element 25 can be separated from the beam 3 by cutting along a cutting plane 41C outside the beam 3 and through the fill material 17 filled between the second lateral side 23 of the beam 3 and the second end 24 of the second floor element 25, or by cutting along a cutting plane 41D through the second floor element 25 in the vicinity of the second end 24 of the second floor element. In both situations, the first transverse reinforcement 8 will also be cut. After such separation of the second floor element 2 from the beam 3 by cutting, the beam 3 can be reused as a component in the same building structure from which the beam 3 was detached or as a component in another building structure as is illustrated in FIGS. 4 and 12, where the second threaded coupler 29 provided at the second free end 27 of the elongated transverse fittings 10 in the beam 3 serves as means for connecting the beam 3 and another second floor element (not marked with a reference numeral) by means of a secondary transverse reinforcement 12 extending between the second lateral side 23 of the beam 3 and the inside of said another second floor element.

In the first embodiment shown in FIG. 1 and the fifth embodiment shown in FIG. 9, the second floor element 25 can be separated from the beam 3 by cutting along a cutting plane 41C outside the beam 3 and through the fill material 17 filled between the second lateral side 23 of the beam 3 and the second end 24 of the second floor element 25, or by cutting along a cutting plane 41D through the second floor element 25 in the vicinity of the second end 24 of the second floor element 28. In both situations, the first transverse reinforcement 8 will also be cut. After such separation of the second floor element 25 from the beam 3 by cutting, the beam 3 can be reused as a component in the same building structure from which the beam 3 was detached or as a component in another building structure as is illustrated in FIGS. 2 and 10, where cut first transverse reinforcement 8 has been removed from the second threaded coupler 29 and the second threaded coupler 29 provided at the second free end 27 of the elongated transverse fittings 10 in the beam 3 serves as means for connecting the beam 3 and another second floor element (not marked with a reference numeral) by means of a secondary transverse reinforcement 12 extending between the second lateral side 23 of the beam 3 and the inside of said another second floor element.

The second floor element 25 can for example be a concrete slab, a hollow-core slab, a filigran type slab, a steel decking, or a wood slab.

The length of the first protective element 14 is preferably, but not necessarily, selected so that the first protective element 14 does not extend in the lateral direction beyond the supporting flange section 4 of the beam 3. An advantage is that the first protective element 14 can easily be found, but saves material by not being unnecessary long. Alternatively the length of the first protective element 14 is selected so that the first protective element 14 extend in the lateral direction beyond the supporting flange section 4 of the beam 3.

The first protective elements 14 can be made of at least one of elastically deformable material such as of polymer, plastic, rubber of a combination thereof, and biodegradable material such as of wood. The first protective element 14 can have an outer covering 37 that is made of softer or more flexible material than an inner core 38 of the protective element as illustrated in FIGS. 24 to 27 and 30 and 31 because of the outer covering 37 that is made of softer or more flexible material, the first protective element 14 can easily be detached from the first free end 13 of the elongated transverse fitting 10 when the beam 3 is separated from the first floor element 2 even in a situation where fill material 17 remains attached to the beam 3. In FIGS. 24 and 25 the first protective element 14 is additionally provided with a hexagonal end 39 for a hexagonal tool (not illustrated) to facilitate screwing of the first protective element 14 off the first threaded coupler 15 of the elongated transverse fitting 10. The first protective element 14 can also be provided with cavities 40 as illustrated in FIGS. 32 to 35 to make it easier to separate the first protective element 14 from the first free end 13 of the elongated transverse fitting 10 when the beam 3 is separated from the first floor element 2 even in a situation where fill material 17 remains attached to the beam 3. Such cavities 40 improves deformability of the first threaded coupler 15. The possible second protective elements 28 can have the same configurations as the first protective elements 14 and as presented above.

The beam 3 is preferably, but not necessarily, at least partly covered with a covering 30 to prevent fill material 17 from adhering to the surface of the beam 3, as illustrated in FIGS. 39 to 41. The advantage of this is that this makes it easier to separate the beam 3 from the first floor element 2 and the possible second floor element 25. The covering 30 can for example be oil, polymer, plastic, rubber or a combination thereof.

The beam 3 comprises preferably, but not necessarily, a vertical plate member 31 projecting from the first supporting surface 6 of the supporting flange section 4 of the beam 3. If the beam 3 has a supporting flange section 4 with both a first supporting surface 6 and a second supporting surface 22, the beam comprises preferably, but not necessarily, a vertical plate member 31 projecting from the first supporting surface 6 of the supporting flange section 4 of the beam 3 and a vertical plate member 31 projecting from the second supporting surface 22 of the supporting flange section 4 of the beam 3.

It is apparent to a person skilled in the art that as technology advanced, the basic idea of the invention can be implemented in various ways. The invention and its embodiments are therefore not restricted to the above examples, but they may vary within the scope of the claims.

LIST OF REFERENCE NUMERALS

1. First end
2. First floor element
3. Beam
4. Supporting flange section
5. Web section
6. First supporting surface
7. First space
8. First transverse reinforcement
9. First lateral side
10. Elongated transverse fitting
11. Concrete
12. Secondary transverse reinforcement
13. First free end
14. First protective element
15. First threaded coupler
16. Anchoring element
17. Fill material
18. Bottom plate of steel
19. First web plate of steel
20. Second web plate of steel
21. Opening
22. Second supporting surface
23. Second lateral side
24. Second end
25. Second floor element
26. Second space
27. Second free end
28. Second protective element
29. Second threaded coupler
30. Covering
31. Vertical plate member
32. Top plate of steel
33. Air openings
34. Threaded studs
35. Tube element
36. Beam space
37. Outer material
38. Inner core
39. Hexagonal end
40. Cavity
41. 41A to 41D: Cutting planes
42. Void
43. Vertical separation member
44. Third space
45. Nut

The invention claimed is:

1. A method for supporting a first end of a first floor element at a beam, wherein the beam being provided with a supporting flange section configured to support the first end of the first floor element and a web section projecting upwards from the supporting flange section, and wherein the method comprises, supporting the first end of the first floor element on a first supporting surface of the supporting flange section at a first lateral side of the beam so that a first space is formed between the first end of the first floor element and the web section of the beam, providing an elongated transverse fitting in the web section of the beam, providing transverse reinforcements to extend between the first lateral side of the beam and the inside of the first floor element, and filling fill material in the first space between the first end of the first floor element and the web section of the beam, providing the elongated transverse fitting to have a first free end at the first lateral side of the beam, and connecting a first protective element to the first free end of the elongated transverse fitting outside the web section of the beam.

2. The method according to claim 1, further comprising, providing the transverse reinforcements in parallel with the elongated transverse fitting and separated from the elongated transverse fitting, and providing the first free end of the elongated transverse fitting with a first threaded coupler.

3. The method according to claim 1, wherein the elongated transverse fitting comprises a tube element, and further comprising arranging the transverse reinforcements inside the tube element.

4. The method according to claim 1, further comprising, providing the first free end of the elongated transverse fitting with a first threaded coupler, and connecting the transverse reinforcements to the threads of the first threaded coupler.

5. The method according to claim 1, wherein the supporting flange section of the beam is additionally provided with a second supporting surface at a second lateral side of the beam, and further comprising, supporting a second end of a second floor element on the second supporting surface of the supporting flange section of the beam so that a second space is formed between the second end of the second floor element and the web section of the beam, arranging the transverse reinforcements to additionally extend between the second lateral side of the beam and the inside of the second floor element, filling fill material in the second space between the second end of the second floor element and the web section of the beam, arranging the elongated transverse fitting to have a second free end at second lateral side of the web section of the beam, and connecting a second protective element to the second free end of the elongated transverse fitting outside the web section of the beam.

6. The method according to claim 1, wherein the first protective element is made of at least one of elastically deformable material, and biodegradable material.

7. The method according to claim 1, further comprising, covering the beam at least partly with a covering to prevent fill material from adhering to the beam.

8. The method according to claim 1, further comprising, providing a vertical plate member to project from the first supporting surface of the supporting flange section of the beam between the web section of the beam and the first end of the first floor element to divide the fill material in the first space into at least two fill material sections separated by the vertical plate member.

9. An arrangement for supporting a first end of a first floor element at a beam, wherein the beam being provided with a supporting flange section configured to support the first end of the first floor element and a web section projecting upwards from the supporting flange section, and wherein in the arrangement the first end of the first floor element is supported on a first supporting surface of the supporting flange section at a first lateral side of the beam so that a first space is formed between the first end of the first floor element and the web section of the beam, an elongated transverse fitting is provided in the web section of the beam, first transverse reinforcements extend between the first lateral side of the beam and the inside of the first floor element, and fill material is filled in the first space between the first end of the first floor element and the web section of the beam, wherein the elongated transverse fitting is provided with a first free end at the first lateral side of the beam, and a first protective element is connected to the first free end of the elongated transverse fitting outside the web section of the beam.

10. The arrangement according to claim 9, wherein the transverse reinforcements is provided in parallel with the elongated transverse fitting and separated from the elongated transverse fitting, and the first free end of the elongated transverse fitting is provided with a first threaded coupler.

11. The arrangement according to claim 9, wherein the elongated transverse fitting comprises a tube element, and the transverse reinforcements are arranged inside the tube element.

12. The arrangement according to claim 9, wherein the first free end of the elongated transverse fitting is provided with a first threaded coupler, and the transverse reinforcements are connected to the threads of the first threaded coupler.

13. The arrangement according to claim 9, wherein the supporting flange section of the beam is additionally provided with a second supporting surface at a second lateral side of the beam, a second end of a second floor element is supported on the second supporting surface of the supporting flange section of the beam so that a second space is formed between the second end of the second floor element and the web section of the beam, the transverse reinforcements are arranged to additionally extend between the second lateral side of the beam and the inside of the second floor element, fill material is filled in the second space between the second end of the second floor element and the web section of the beam, the elongated transverse fitting is arranged to have a second free end at second lateral side of the web section of the beam, and a second protective element is connected to the second free end of the elongated transverse fitting outside the web section of the beam.

14. The arrangement according to claim 9, wherein the first protective element is made of at least one of elastically deformable material, and biodegradable material.

15. The arrangement according to claim 9, wherein the beam is at least partly covered with a covering to prevent fill material from adhering to the beam.

16. The arrangement according to claim 9, wherein a vertical plate member is projecting from the first supporting surface of the supporting flange section of the beam between the web section of the beam and the first end of the first floor element to divide the fill material in the first space into at least two fill material sections separated by the vertical plate member.

17. A beam for supporting a first end of a first floor element, wherein the beam being provided with a supporting flange section configured to support the first end of the first floor element and a web section projecting upwards from the supporting flange section, wherein the supporting flange section of the beam comprises a first supporting surface at a first lateral side of the beam and configured to support the first end of the first floor element so that a first space is formed between the first end of the first floor element and the supporting flange section of the beam, and the web section of the beam comprises an elongated transverse fitting provided in the web section of the beam and configured to receive secondary transverse reinforcements configured to extend between the first lateral side of the beam and the inside of the first floor element supported on the first supporting surface of the supporting flange section of the beam, wherein the elongated transverse fitting is provided with a first free end at the first lateral side of the beam, and a first protective element is connected to the first free end of the elongated transverse fitting outside the web section of the beam.

18. The beam according to claim 17, wherein the transverse reinforcements are provided in parallel with the elongated transverse fitting and separated from the elongated transverse fitting, and the first free end of the elongated transverse fitting is provided with a first threaded coupler.

19. The beam according to claim 17, wherein the elongated transverse fitting comprise tube elements, and the tube elements are configured to receive the elongated transverse reinforcements.

20. The beam according to claim 17, wherein the first free end of the elongated transverse fitting is provided with a first threaded coupler, and the threads of the first threaded couplers are configured to receive additionally the elongated transverse reinforcements.

21. The beam according to claim 17, wherein the supporting flange section of the beam is additionally provided with a second supporting surface at a second lateral side of the beam and configured for supporting a second end of a second floor element so that a second space is formed between the second end of the second floor element and the web section of the beam, the elongated transverse fitting in the web section of the beam are configured to receive the elongated transverse reinforcements so that elongated transverse reinforcements additionally extend between the second lateral side of the beam and the inside of the second floor element supported on the second supporting surface of the supporting flange section of the beam, the elongated transverse fitting is provided with a second free end at second lateral side of the web section of the beam, and a second protective element is connected to the second free end of the elongated transverse fitting outside the web section of the beam.

22. The beam according to claim 17, wherein the first protective element is made at least one of elastically deformable material, and biodegradable material.

23. The beam according to claim 17, wherein the beam is at least partly covered with a covering to prevent fill material from adhering to the surface of the beam.

24. The beam according to claim 17, wherein a vertical plate member projects from the first supporting surface of the supporting flange section of the beam between the web section of the beam and the first end of the first floor element.

* * * * *